US011654085B2

(12) United States Patent
Malhotra et al.

(10) Patent No.: US 11,654,085 B2
(45) Date of Patent: May 23, 2023

(54) METHOD OF MAKING DUAL CHAMBER FLEXIBLE CONTAINER

(71) Applicants: Baxter International Inc., Deerfield, IL (US); Baxter Healthcare SA, Glattpark (CH)

(72) Inventors: Atul Malhotra, Vernon Hills, IL (US); Gianni Di Stefani, Ath (BE); John Doherty, Westport County (IE); Mark Timothy Foote, Lakemoor, IL (US); Eric J. Henaut, Arquennes (BE); Stephane Spataro, Sart-Dames-Aveline (BE); Johanny Stanus, Gilbecq (BE); Joost M. Vancaillie, Lombise (BE)

(73) Assignees: Baxter International Inc., Deerfield, IL (US); Baxter Healthcare SA, Glattpark (CH)

( * ) Notice: Subject to any disclaimer, the term of this patent is extended or adjusted under 35 U.S.C. 154(b) by 307 days.

(21) Appl. No.: 16/415,767

(22) Filed: May 17, 2019

(65) Prior Publication Data

US 2019/0350811 A1 Nov. 21, 2019

Related U.S. Application Data

(60) Provisional application No. 62/673,584, filed on May 18, 2018.

(51) Int. Cl.
*A61J 1/20* (2006.01)
*A61J 1/14* (2023.01)
(Continued)

(52) U.S. Cl.
CPC ..... *A61J 1/2093* (2013.01); *A61J 1/10* (2013.01); *A61J 1/1468* (2015.05); *A61J 1/1475* (2013.01);
(Continued)

(58) Field of Classification Search
CPC ..... A61J 1/10; A61J 1/1406; A61J 1/1468; A61J 1/1475; A61J 1/2024; A61J 1/2093;
(Continued)

(56) References Cited

U.S. PATENT DOCUMENTS 4,516,977 A * 5/1985 Herbert ..... B32B 27/08 604/415
4,548,606 A 10/1985 Larkin
(Continued)

FOREIGN PATENT DOCUMENTS

CA 2852778 11/2014
EP 0513364 2/1995
(Continued)

OTHER PUBLICATIONS

IPRP and Written Opinion for PCT/US2019/032944 dated Nov. 24, 2020 (14 pages).
(Continued)

*Primary Examiner* — Robert F Long
*Assistant Examiner* — Eduardo R Ferrero
(74) *Attorney, Agent, or Firm* — K&L Gates LLP

(57) ABSTRACT

A multiple chamber container forming and filling method includes (i) forming at least one strong seal around a periphery of first and second sheets so as to leave an opening between the first and second sheets; (ii) forming a temporary peel seal across the opening; (iii) forming a mixing peel seal between the first and second sheets so as to separate a diluent chamber from a powdered drug chamber; (iv) adding diluent to the diluent chamber; (v) sterilizing the multiple chamber container including the diluent; (vi) opening the temporary peel seal in an aseptic environment; (vii) adding powdered drug to the powdered drug chamber through the opening; and (viii) strong sealing the opening so as to be closed.

11 Claims, 14 Drawing Sheets

(51) Int. Cl.

| | |
|---|---|
| ***A61J 1/10*** | (2006.01) |
| ***B65B 3/00*** | (2006.01) |
| ***B65B 3/02*** | (2006.01) |
| ***B65B 55/02*** | (2006.01) |
| ***B65B 3/04*** | (2006.01) |
| ***B65D 81/32*** | (2006.01) |
| *B65B 31/04* | (2006.01) |
| *B65D 25/08* | (2006.01) |

(52) U.S. Cl.
CPC ..... *A61J 1/2024* (2015.05); *B65B 3/003* (2013.01); *B65B 3/02* (2013.01); *B65B 3/04* (2013.01); *B65B 55/02* (2013.01); *B65D 81/3266* (2013.01); *A61J 1/1406* (2013.01); *B65B 31/042* (2013.01); *B65B 31/043* (2013.01); *B65B 31/048* (2013.01); *B65D 25/08* (2013.01); *B65D 81/32* (2013.01)

(58) Field of Classification Search
CPC ..... B65B 3/003; B65B 3/02; B65B 55/02; B65B 31/08; B65B 31/043; B65B 31/048; B65B 31/044; B65B 3/04; B65D 75/5855; B65D 81/3266; B65D 81/3261; B65D 81/32; B65D 25/08; B32B 7/08
USPC ..... 206/219, 221; 383/38–40
See application file for complete search history.

(56) References Cited

U.S. PATENT DOCUMENTS 4,561,110 A * 12/1985 Herbert ..... B32B 7/12 604/408
4,608,043 A * 8/1986 Larkin ..... A61J 1/2093 604/87
5,176,634 A * 1/1993 Smith ..... A61J 1/2093 604/416
5,257,986 A 11/1993 Herbert et al.
5,267,646 A 12/1993 Inoue et al.
5,423,421 A * 6/1995 Inoue ..... A61J 1/00 206/219
5,459,978 A * 10/1995 Weiss ..... A61L 2/07 53/425
5,462,526 A * 10/1995 Barney ..... A61J 1/2093 604/85
5,520,975 A * 5/1996 Inoue ..... B32B 27/32 428/35.9
5,706,937 A * 1/1998 Futagawa ..... B32B 27/36 206/221
5,871,477 A 2/1999 Isono et al.
5,910,138 A * 6/1999 Sperko ..... B29C 65/02 604/408
5,928,213 A * 7/1999 Barney ..... C08L 23/0815 604/410
5,944,709 A 8/1999 Barney
6,007,529 A 12/1999 Gustafsson et al.
6,117,123 A 9/2000 Barney et al.
6,186,998 B1 2/2001 Inuzuka et al.
6,231,559 B1 5/2001 Loretti
6,306,473 B1 10/2001 Denpou et al.
6,364,864 B1 * 4/2002 Mohiuddin ..... A61J 1/10 206/219
6,541,029 B1 4/2003 Namba et al.
6,645,191 B1 11/2003 Knerr et al.
6,663,829 B1 12/2003 Kjellstrand
6,682,517 B1 1/2004 Ezaki et al.
6,902,335 B2 6/2005 Bergey et al.
6,996,951 B2 2/2006 Smith et al.
7,169,138 B2 1/2007 Becker et al.
7,243,787 B2 7/2007 Iwasa et al.
7,458,741 B2 12/2008 Detwiler et al.
7,618,406 B2 11/2009 Roger
7,658,279 B2 2/2010 Oka et al.
7,770,611 B2 * 8/2010 Houwaert ..... A61J 1/2093 141/114
7,776,414 B2 8/2010 Iwasaki et al.
7,780,644 B2 8/2010 Miyajima et al.
7,875,015 B2 1/2011 Pahlberg et al.
7,875,016 B2 1/2011 Pahlberg et al.
7,935,101 B2 5/2011 Muramatsu
7,976,526 B2 7/2011 Kitagawa et al.
7,976,917 B2 7/2011 Suzuki et al.
8,029,878 B2 10/2011 Omori et al.
8,118,158 B2 2/2012 Igota et al.
8,157,783 B2 4/2012 Yoshikawa
8,163,361 B2 4/2012 Tateishi et al.
8,197,460 B2 6/2012 Wieslander et al.
8,235,965 B2 8/2012 Roger
8,328,017 B2 12/2012 Perell
8,343,128 B2 1/2013 Nagao et al.
8,343,129 B2 1/2013 Falkvall et al.
8,404,274 B2 3/2013 Sumiyoshi et al.
8,449,520 B2 * 5/2013 Pepper ..... A61B 90/96 34/284
8,484,937 B1 * 7/2013 Gabriel ..... B65B 25/068 53/479
8,485,727 B2 7/2013 Trouilly et al.
8,491,562 B2 7/2013 Choi et al.
8,617,133 B2 12/2013 Muramatsu et al.
8,668,681 B2 3/2014 Shimizu et al.
8,668,971 B2 3/2014 Suzuki et al.
8,777,922 B2 7/2014 Inoue et al.
8,845,611 B2 9/2014 Tsuruoka et al.
8,960,438 B2 2/2015 Murray
9,004,761 B2 4/2015 Balteau et al.
9,022,653 B2 5/2015 Pittet et al.
9,061,819 B2 * 6/2015 Kane, Jr. ..... B65D 81/3266
9,078,808 B2 7/2015 Roy et al.
9,095,499 B2 8/2015 Kugelmann et al.
9,132,220 B2 9/2015 Kugelmann et al.
9,254,357 B2 2/2016 Falkvall et al.
9,278,049 B2 3/2016 McIntyre et al.
9,278,051 B2 4/2016 Inoue et al.
9,320,680 B2 4/2016 Schroder
9,334,098 B1 5/2016 Hughes
9,365,316 B2 6/2016 Flank et al.
9,446,184 B2 9/2016 Tani et al.
9,687,600 B2 6/2017 Tani et al.
9,855,378 B2 1/2018 Brandl et al.
9,856,045 B2 1/2018 Wu
10,226,400 B2 3/2019 Kouno et al.
2004/0001065 A1 1/2004 Grayson
2004/0137177 A1 7/2004 Saito et al.
2005/0017712 A1 8/2005 Nagao et al.
2006/0035044 A1 2/2006 Kenji
2006/0260967 A1 * 11/2006 Clarke ..... A61F 2/0095 206/438
2007/0075714 A1 4/2007 Dollinger et al.
2007/0261974 A1 * 11/2007 Balteau ..... B29C 66/81427 206/219
2007/0289884 A1 * 12/2007 Py ..... B67D 3/0012 206/221
2008/0017543 A1 * 1/2008 Pahlberg ..... A61M 1/167 206/532
2008/0044606 A1 * 2/2008 Omori ..... B32B 3/02 428/35.9
2008/0313998 A1 * 12/2008 Ligon ..... B65B 9/08 53/455
2009/0238495 A1 9/2009 Anderson
2009/0299324 A1 12/2009 Inoue et al.
2009/0931089 12/2009 Suzuki et al.
2010/0037566 A1 * 2/2010 Hansen ..... B65B 31/044 53/510
2010/0179505 A1 * 7/2010 Muramatsu ..... A61J 1/1475 604/410
2012/0323209 A1 12/2012 Falkvall et al.
2013/0012912 A1 1/2013 Suzuki et al.
2013/0039603 A1 2/2013 Pittet et al.
2013/0046271 A1 2/2013 Pittet et al.
2013/0123741 A1 5/2013 Bolduc et al.

(56) References Cited

U.S. PATENT DOCUMENTS

| | | | | |
|---|---|---|---|---|
| 2013/0126370 | A1* | 5/2013 | DiLiberto | B65D 81/3266 206/219 |
| 2013/0153448 | A1 | 6/2013 | Yoshikawa | |
| 2013/0304016 | A1 | 11/2013 | Kouno et al. | |
| 2015/0041475 | A1* | 2/2015 | Swamy | B65B 51/10 220/359.2 |
| 2015/0059288 | A1* | 3/2015 | Wu | B65B 29/10 53/426 |
| 2015/0079688 | A1 | 3/2015 | Kahaian et al. | |
| 2015/0335856 | A1* | 11/2015 | Utas | B65B 3/04 53/436 |
| 2016/0106519 | A1 | 4/2016 | Hashiguchi et al. | |
| 2016/0193400 | A1 | 7/2016 | Falkvall et al. | |
| 2017/0100307 | A1 | 4/2017 | Frattini | |
| 2018/0028401 | A1 | 2/2018 | Chen | |
| 2018/0201443 | A1 | 7/2018 | Yamagishi | |
| 2019/0021953 | A1 | 1/2019 | Ravussin et al. | |

FOREIGN PATENT DOCUMENTS

| | | |
|---|---|---|
| EP | 0704199 | 4/1996 |
| EP | 1621177 | 2/2006 |
| EP | 2517686 | 10/2012 |
| FR | 3027220 | 4/2016 |
| GB | 2117744 | 10/1983 |
| JP | H10 216200 | 8/1998 |
| JP | 2004-182330 | 7/2004 |
| WO | 2018201443 | 11/2018 |

OTHER PUBLICATIONS

International Search Report and the Written Opinion of the International Searching Authority for PCT/US2019/032944 dated Nov. 11, 2019 (24 pages).

Japanese Office Action for App. No. 2020-564390 dated Dec. 27, 2022 (7 pages).

* cited by examiner

METHOD OF MAKING DUAL CHAMBER FLEXIBLE CONTAINER

PRIORITY

This application claims priority to and the benefit of U.S. Provisional Application No. 62/673,584, filed May 18, 2018, entitled, "Dual Chamber Flexible Container And Drug Product Using Same", the entire contents of which are hereby incorporated by reference and relied upon.

BACKGROUND

The present disclosure relates generally to medical device packaging and more specifically to drug delivery packaging.

Drugs such as antibiotics that are not stable in solution at room temperature over a desired shelf life can be stored in different forms to maintain stability. In a first form, the drug is premixed for use and then frozen. Here, the drug advantageously does not have to be mixed prior to delivery, but must be stored in a frozen state. Maintaining the drug in a frozen state requires a specialized storage location, costly energy, and time to thaw the drug prior to delivery. Freezing the drug is accordingly not optimal for certain healthcare providers.

Another way to store drugs such as antibiotics is to separate the drug from its liquid delivery medium, i.e., a diluent. Traditionally, the separation has been done by providing the powdered drug in a septum-capped vial that can be reconstituted with diluent by a hospital pharmacist. Ordinarily, this requires the pharmacist to withdraw a syringeful of diluent from a separate IV solution container, inject the diluent into the vial to dissolve the drug, withdraw the dissolved drug from the vial via syringe and reinject the drug into the IV container to prepare a drug solution ready for administration. It will be appreciated that each step of this procedure presents an opportunity for error and/or contamination of the finished drug dose.

A number of solutions have been proposed for reducing the amount of steps required to prepare a drug solution from a powdered drug. The MINI-BAG Plus™ product provided by the assignee of the present disclosure is one such system. As disclosed in U.S. Pat. No. 5,304,163, the MINI-BAG Plus™ product includes a diluent bag having an integrated adapter forming an admixture system. The adapter connects to a standard twenty millimeter ("mm") closure, single-dose, powdered-drug vial. The bag holds dextrose or saline diluent. The user connects the drug vial to the adapter and then opens a frangible valve to allow the diluent to flow into the vial and dissolve the drug, and then causes the mixture to flow back into the diluent bag. The bag is also provided with an administration port. The administration port is spiked by a hollow spike of an IV administration set to allow the reconstituted drug solution in the bag to flow through a tube of the administration set via gravity or infusion pump to the patient. In a similar system described in U.S. Pat. No. 4,614,567 ("the '567 Patent"), a port on an IV solution container is adapted to mate with a specially configured vial containing the powdered drug. In the '567 Patent system, the vial closure and port closure can be opened together to create a fluid connection between the vial contents and the diluent in the bag. The combined contents of bag and vial can then be administered intravenously to the patient.

Another system separating the drug from its liquid delivery medium is described in U.S. Pat. No. 5,944,709 ("the '709 Patent"). The '709 Patent teaches a multi-compartment drug container for storing and mixing together diluents and drugs. The container incorporates multiple compartments, separated by peelable seals, in which the diluents and drugs are stored. The peelable seals are ruptured by manipulation of the container to thereby mix the contents together for delivery to a patient.

In any of the different ways to separate the drug from its liquid delivery medium, it may become expensive and difficult to provide the drug, especially in the quantities that may be needed for certain popular types of antibiotics. Certain of the previous approaches require specialized vials or significant manipulation by the pharmacist to reconstitute the drug. There thus remains a need for improved ways to keep a powdered drug separate from its liquid delivery medium, while still permitting easy reconstitution of the drug solution for patient administration.

SUMMARY

The examples described herein disclose a dual chamber flexible container, e.g., a bag, and a drug delivery product using the same. The dual chamber bag includes a diluent chamber, a drug chamber and an administration area leading to an administration port. A first, mixing peel seal is located between the diluent chamber and the drug chamber. A second, delivery peel seal is located between the drug chamber and the administration port. The mixing peel seal may have the same strength as the delivery peel seal (i.e., require approximately the same force to open the seals). Or, the mixing peel seal may be stronger or weaker than the delivery peel seal (require more or less force to open the mixing peel seal than the delivery peel seal).

The dual chamber bag may be made of one or more polymer sheets having two or more layers. For example, there may be three layers including a seal layer (closest to diluent and drug), a middle layer, and a skin layer (outer layer). The layers may each include one or more polymers, such as polypropylene ("PP"), propylene-ethylene copolymer ("EPR") and/or a styrene-olefin-styrene block copolymer elastomer (commonly referred to as styrene ethylene butylene styrene ("SEBS") or styrene ethylene propylene styrene ("SEPS"), and which may include other elastomers. The bag may be made of a single sheet, which is folded and sealed together along all sides, folded and non-folded, or along the non-folded sides only. Or, the bag may be made from separate sheets and sealed together along all sides. Such sealing may include any one or more of ultrasonic welding, heat sealing, radio-frequency induced heat sealing, solvent bonding and the like. Typically, however, carefully controlled heat sealing is performed.

The seals formed along the outer sides of the dual chamber bag are strong seals relative to the weaker peel seals of the bag. Variously sized and shaped apertures may be formed in at least two of the strong seals for use in hanging the dual chamber bag for administration and/or positioning the bag during sterilization and/or filling.

The peel seals may be straight or have a more complex, nonlinear shape. In one embodiment, a portion of the delivery peel seal has a trapezoidal shape (three sides of the trapezoid), in which the peel seal extends along the two sides and the shorter base of the trapezoid, which is set off from the longer base of the trapezoid in a direction away from the administration port of the bag. The trapezoid moves the seal away from the administration port to allow room for the port and so that the peel seal does not come too close to the port, which could pinch the sheets of the bag at the port, placing stress on the peel seal and rupturing the weak seal. The trapezoidal path allows the peel seal to exist stress free until opened.

The administration port of the dual chamber bag may be provided with a medically safe rubber, e.g., a thermoplastic elastomer ("TPE") insert, which accommodates a broad range of spike heads provided with the administration sets. The administration port may be made of a harder plastic (e.g., polypropylene ("PP")) outer port, which is fitted with the more compressible TPE insert, which is spiked by the spike head of the administration set. The TPE insert provides flexibility to accept non-standard or differently sized spikes without leakage.

At least one face, and in an embodiment both faces, of the drug chamber are covered by a removably affixed opaque layer, such as an aluminum foil layer. The opaque layer protects the drug within the drug chamber from light and/or air. To aid the oxygenation protection, the opaque layer may have gas-barrier properties. In an embodiment, the opaque layer is sized to cover the seals surrounding the drug chamber, including the peel seals, and is removably sealed to the outside face of the drug container substantially along the outline of the drug container defined by the permanent and peelable seals. Each opaque layer includes at least one non-sealed tab used to initiate removal of the opaque layer, which may be located adjacent to one of the seals. In an embodiment, a seal for the opaque layer extends between the delivery peel seal and the administration port, so that the seal for the opaque layer does not in any way interrupt (i) the delivery peel seal or (ii) the powdered drug chamber bounded in part by the delivery peel seal. Alternatively, the opaque layer seal may completely cover the delivery peel seal. In a further alternative embodiment, two delivery peel seals are provided, one completely covered by the opaque layer seal, the other not covered at all by the opaque layer seal.

The drug and diluent filled product of the present disclosure using the dual chamber bag is formed in two stages in one embodiment. In a first stage, the diluent chamber of the bag is filled with diluent e.g., dextrose, saline solution, or sterile water for injection, in a non-aseptic manner and is thereafter moist heat sterilized. In an embodiment, the dual chamber bag is subjected to steam at 120 to 125° C. for twenty to thirty minutes. In a second stage, the drug chamber of the diluent-filled dual chamber bag is aseptically filled with a drug in powder form. In one embodiment, the powder is provided in a sterilized form. Filling of the powdered drug may be aided by a temporary peel seal that is opened to inject the drug, after which the area of the container having the temporary peel seal is strong sealed. Thus, after the drug has been delivered aseptically to the drug chamber, the dual chamber bag is completely loaded and sterile. The protective opaque layer is provided in one preferred embodiment after aseptic filling of the drug powder. Very generally, the major steps of this first embodiment may include: bag forming with temporary drug peel seal, diluent filling, sterilization and drying, aseptic transfer to cleanroom, temporary drug peel seal opening, powder drug filling, drug chamber sealing, opaque layer sealing, and overpouching.

In one alternative embodiment, the powdered drug filling stage is performed before the diluent filling stage. Here, the diluent may have to be aseptically filled if the drug cannot withstand moist heat sterilization.

In another alternative embodiment, filling of both the powdered drug and the diluent is performed in an aseptic environment. Here, filling may be aided by two temporary peel seals, which are each opened to inject the powdered drug and diluent, respectively, after which the areas of the containers having the temporary peel seals are strong sealed. Very generally, the major steps of this third embodiment may include: bag forming with temporary drug and diluent peel seals, dry bag sterilization such as irradiation, aseptic transfer to cleanroom, temporary drug peel seal opening, powder drug filling, drug chamber sealing, temporary diluent peel seal opening, diluent filling, diluent chamber sealing, opaque layer sealing, and overpouching.

Moreover, to reduce the amount of solid material that must be aseptically filled, it is contemplated to remove one or more components of the dry drug powder (relative to known dry formulations of the drug as ordinarily supplied in vials) and to provide it instead with the liquid diluent. Components suitable for removal from the drug powder include buffers, tonicity adjusters, or other soluble additives that withstand moist heat sterilization. The removed one or more components are provided instead in the liquid diluent.

In light of the embodiments discussed herein, and without limiting the present disclosure in any way, in a first aspect of the present disclosure, which may be combined with any other aspect unless specified otherwise, a multiple chamber container includes: a first sheet; a second sheet; a first peel seal between the first and second sheets, the first peel seal extending across the first and second sheets; wherein at a first time at least one strong seal is provided around a periphery of the first and second sheets so as to leave an opening between the first and second sheets, and wherein a second peel seal is provided between the first and second sheets, the second peel seal extending across the opening between the first and second sheets; and wherein at a second time the second peel seal is removed and the at least one strong seal is extended to seal the opening between the first and second sheets.

In a second aspect of the present disclosure, which may be combined with any other aspect unless specified otherwise, the first peel seal extends between the periphery of the first and second sheets and divides the container into multiple chambers.

In a third aspect of the present disclosure, which may be combined with the second aspect in combination with any other aspect unless specified otherwise, one of the chambers is provided to accept a powdered drug, and wherein the second peel seal extends across the opening between the first and second sheets at a peripheral portion of the powdered drug chamber.

In a fourth aspect of the present disclosure, which may be combined with the second aspect in combination with any other aspect unless specified otherwise, one of the chambers is provided to accept a diluent, wherein the opening between the first and second sheets is a first opening, and wherein at the first time a second opening is provided at a portion of the periphery of the diluent chamber to allow diluent to be added to the diluent chamber.

In a fifth aspect of the present disclosure, which may be combined with the fourth aspect in combination with any other aspect unless specified otherwise, at the second time the at least one strong seal is extended to seal the second opening between the first and second sheets.

In a sixth aspect of the present disclosure, which may be combined with any other aspect unless specified otherwise, at the first time a third peel seal is provided between the first and second sheets, the third peel seal extending across the first and second sheets so as to restrict access to an outlet of the multiple chamber container.

In a seventh aspect of the present disclosure, which may be combined with the sixth aspect in combination with any other aspect unless specified otherwise, the outlet of the multiple chamber container includes an administration port.

In an eighth aspect of the present disclosure, which may be combined with the sixth aspect in combination with any other aspect unless specified otherwise, a sealing strength of the first peel seal is greater than a sealing strength of the third peel seal, and wherein the sealing strength of the third peel seal is greater than a sealing strength of the second peel seal.

In a ninth aspect of the present disclosure, which may be combined with the sixth aspect in combination with any other aspect unless specified otherwise, a width of the third peel seal is greater than or equal to a width of the second peel seal.

In a tenth aspect of the present disclosure, which may be combined with the sixth aspect in combination with any other aspect unless specified otherwise, at the second time the third peel seal remains, while the second peel seal is removed.

In an eleventh aspect of the present disclosure, which may be combined with any other aspect unless specified otherwise, the second peel is sized to extend into the at least one peripheral strong seal.

In a twelfth aspect of the present disclosure, which may be combined with any other aspect unless specified otherwise, a multiple chamber container includes a first sheet; a second sheet; a first peel seal between the first and second sheets, the first peel seal extending across the first and second sheets; a second peel seal between the first and second sheets, the second peel seal extending across the first and second sheets; and a third peel seal between the first and second sheets, the third peel seal extending along a periphery of the first and second sheets.

In a thirteenth aspect of the present disclosure, which may be combined with the twelfth aspect in combination with any other aspect unless specified otherwise, the first peel seal is wider than the second peel seal, and wherein the second peel seal has a same width or is wider than the third peel seal.

In a fourteenth aspect of the present disclosure, which may be combined with the twelfth aspect in combination with any other aspect unless specified otherwise, the third peel seal is at least substantially straight, and wherein at least one of the first and second seals is non-linear.

In a fifteenth aspect of the present disclosure, which may be combined with the twelfth aspect in combination with any other aspect unless specified otherwise, a sealing strength of the first peel seal is greater than a sealing strength of the second peel seal, and wherein the sealing strength of the second peel seal is greater than a sealing strength of the third peel seal.

In a sixteenth aspect of the present disclosure, which may be combined with the twelfth aspect in combination with any other aspect unless specified otherwise, the first and second peel seals extend across the first and second sheets to at least one peripheral strong seal between the first and second sheets.

In a seventeenth aspect of the present disclosure, which may be combined with the twelfth aspect in combination with any other aspect unless specified otherwise, the third peel seal is formed with an opening sized to accept a gas injecting structure.

In an eighteenth aspect of the present disclosure, which may be combined with any other aspect unless specified otherwise, a multiple chamber container formed and filled by a method includes: forming at least one strong seal around a periphery of first and second sheets so as to leave an opening between the first and second sheets; forming a temporary peel seal across the opening; forming a mixing peel seal between the first and second sheets so as to separate a diluent chamber from a powdered drug chamber; adding diluent to the diluent chamber; sterilizing the multiple chamber container including the diluent; opening the temporary peel seal in an aseptic environment; adding powdered drug to the powdered drug chamber through the opening; and strong sealing the opening so as to be closed.

In a nineteenth aspect of the present disclosure, which may be combined with the eighteenth aspect in combination with any other aspect unless specified otherwise, the opening is a first opening, and wherein forming the at least one strong seal around the periphery of the first and second sheets includes leaving a second opening between the first and second sheets for filling the diluent.

In a twentieth aspect of the present disclosure, which may be combined with the nineteenth aspect in combination with any other aspect unless specified otherwise, the method forming the multiple chamber container includes strong sealing the second opening so as to be closed prior to sterilizing the multiple chamber container.

In a twenty-first aspect of the present disclosure, which may be combined with the eighteenth aspect in combination with any other aspect unless specified otherwise, the method forming the multiple chamber container includes forming a delivery peel seal between the powdered drug chamber and an outlet of the multiple chamber container.

In a twenty-second aspect of the present disclosure, which may be combined with any other aspect unless specified otherwise, a multiple chamber container includes: a first sheet; a second sheet; a first peel seal between the first and second sheets, the first peel seal extending across the first and second sheets to form first and second chambers; wherein at a first time at least one strong seal is provided around a periphery of the first and second sheets so as to leave first and second openings for the first and second chambers, respectively, between the first and second sheets, wherein a second peel seal is provided between the first and second sheets, the second peel seal extending across the first opening between the first and second sheets, and wherein a third peel seal is provided between the first and second sheets, the third peel seal extending across the second opening between the first and second sheets; and wherein at a second time the second and third peel seals are removed and the at least one strong seal is extended to seal the first and second openings between the first and second sheets.

In a twenty-third aspect of the present disclosure, which may be combined with the twenty-second aspect in combination with any other aspect unless specified otherwise, at the first time a fourth peel seal is provided between the first and second sheets, the fourth peel seal extending across the first and second sheets so as to restrict access to an outlet of the multiple chamber container.

In a twenty-fourth aspect of the present disclosure, which may be combined with the twenty-third aspect in combination with any other aspect unless specified otherwise, the outlet of the multiple chamber container includes an administration port.

In a twenty-fifth aspect of the present disclosure, which may be combined with the twenty-third aspect in combination with any other aspect unless specified otherwise, a sealing strength of the first peel seal is greater than a sealing strength of the fourth peel seal, and wherein the sealing strength of the fourth peel seal is greater than a sealing strength of the second and third peel seals.

In a twenty-sixth aspect of the present disclosure, which may be combined with the twenty-third aspect in combination with any other aspect unless specified otherwise, a width of the fourth peel seal is greater than or equal to a width of the second and third peel seals.

In a twenty-seventh aspect of the present disclosure, which may be combined with the twenty-third aspect in combination with any other aspect unless specified otherwise, at the second time the first and the fourth peel seals remain, while the second and third peel seals are removed.

In a twenty-eighth aspect of the present disclosure, which may be combined with any other aspect unless specified otherwise, a multiple chamber container formed and filled by a method including: forming at least one strong seal around a periphery of first and second sheets so as to leave first and second openings between the first and second sheets; forming a first temporary peel seal across the first opening; forming a second temporary peel seal across the second opening; forming a mixing peel seal between the first and second sheets so as to separate a powdered drug chamber from a diluent chamber; opening the first temporary peel seal in an aseptic environment; adding powdered drug to the powdered drug chamber through the first opening; strong sealing the first opening so as to be closed; opening the second temporary peel seal in an aseptic environment; adding diluent to the diluent chamber through the second opening; and strong sealing the second opening so as to be closed.

In a twenty-ninth aspect of the present disclosure, which may be combined with the twenty-eighth aspect in combination with any other aspect unless specified otherwise, the multiple chamber container formed and filled by the method includes forming a delivery peel seal between the powdered drug chamber and an outlet of the multiple chamber container.

In a thirtieth aspect of the present disclosure, which may be combined with the twenty-eighth aspect in combination with any other aspect unless specified otherwise, at least one of (i) the first opening and the first temporary peel seal extend along the powdered drug chamber or (ii) the second opening and the second temporary peel seal extend along the diluent chamber.

In a thirty-first aspect of the present disclosure, which may be combined with any other aspect unless specified otherwise, a multiple chamber container product includes: a diluent chamber; a drug chamber; an administration port; strong seals sealing an outside of the diluent chamber and drug chamber; a first peel seal located between the diluent chamber and the drug chamber; a second peel seal located between the drug chamber and the administration port; a powdered drug missing at least one component normally provided with the powdered drug; and a pharmaceutically acceptable diluent solution including the at least one component normally provided with the powdered drug.

In a thirty-second aspect of the present disclosure, which may be combined with the thirty-first aspect in combination with any other aspect unless specified otherwise, the at least one component normally provided with the powdered drug includes a buffer or a tonicity adjuster.

In a thirty-third aspect of the present disclosure, which may be combined with the thirty-first aspect in combination with any other aspect unless specified otherwise, the powdered drug is an antibiotic.

In a thirty-fourth aspect of the present disclosure, which may be combined with the thirty-first aspect in combination with any other aspect unless specified otherwise, the diluent includes dextrose or saline.

In a thirty-fifth aspect of the present disclosure, which may be combined with any other aspect unless specified otherwise, a multiple chamber container includes: plural opposing layers of a flexible film, said layers permanently sealed together with a peripheral seal to define an interior fluid space; a first peelable seal formed between the film layers and defining a diluent chamber at one end of the fluid space; an administration port disposed in the peripheral seal remote from the diluent chamber and providing a flow pathway out of the fluid space; and a second peelable seal obstructing fluid flow between the interior fluid space and the administration port, wherein the first and second peelable seals and the peripheral seal define a drug chamber between the diluent chamber and the administration port, and wherein a central portion of the second peel seal is non-linear and extended away from the administration port a distance sufficient such that the non-linear central portion of the second peel seal is substantially unstressed by the administration port.

In another aspect of the present disclosure, which may be combined with any other aspect unless specified otherwise, a delivery peel seal is provided that obstructs access to an administration port, wherein the delivery peel seal includes first and second seals, the first seal covered by an opaque layer seal to the container, the second peel seal uncovered by the opaque layer seal to the container.

In a thirty-sixth aspect of the present disclosure, which may be combined with any other aspect unless specified otherwise, a multiple chamber container forming and filling method includes: forming at least one strong seal around a periphery of first and second sheets so as to leave an opening between the first and second sheets; forming a temporary peel seal across the opening; forming a mixing peel seal between the first and second sheets so as to separate a diluent chamber from a powdered drug chamber; adding diluent to the diluent chamber; sterilizing the multiple chamber container including the diluent; opening the temporary peel seal in an aseptic environment; adding powdered drug to the powdered drug chamber through the opening; and strong sealing the opening so as to be closed.

In a thirty-seventh aspect of the present disclosure, which may be combined with the thirty-sixth aspect in combination with any other aspect unless specified otherwise, the opening is a first opening, and wherein forming the at least one strong seal around the periphery of the first and second sheets includes leaving a second opening between the first and second sheets for adding the diluent.

In a thirty-eighth aspect of the present disclosure, which may be combined with the thirty-seventh aspect in combination with any other aspect unless specified otherwise, the method includes strong sealing the second opening so as to be closed prior to sterilizing the multiple chamber container.

In a thirty-ninth aspect of the present disclosure, which may be combined with the thirty-sixth aspect in combination with any other aspect unless specified otherwise, the method includes forming a delivery peel seal between the powdered drug chamber and an outlet of the multiple chamber container.

In a fortieth aspect of the present disclosure, which may be combined with the thirty-sixth aspect in combination with any other aspect unless specified otherwise, forming the temporary peel seal across the opening includes leaving a smaller opening in the temporary peel seal to accept a gas injecting structure.

In a forty-first aspect of the present disclosure, which may be combined with the fortieth aspect in combination with any other aspect unless specified otherwise, the method includes closing the smaller opening after inserting gas through the smaller opening.

In a forty-second aspect of the present disclosure, which may be combined with the thirty-sixth aspect in combination with any other aspect unless specified otherwise, the method includes inserting gas into the powdered drug chamber prior to opening the temporary peel seal.

In a forty-third aspect of the present disclosure, which may be combined with the forty-second aspect in combination with any other aspect unless specified otherwise, the gas is at least one of an inerting gas or an oxygen getting gas.

In a forty-fourth aspect of the present disclosure, which may be combined with the forty-second aspect in combination with any other aspect unless specified otherwise, the gas separates the first and second sheets, and wherein opening the temporary peel seal includes suctioning the separated first and second sheets and pulling on the temporary peel seal.

In a forty-fifth aspect of the present disclosure, which may be combined with the thirty-sixth aspect in combination with any other aspect unless specified otherwise, the opening and the temporary peel seal border the powdered drug chamber.

In a forty-sixth aspect of the present disclosure, which may be combined with the thirty-sixth aspect in combination with any other aspect unless specified otherwise, the method includes sterilizing the powdered drug prior to adding the powdered drug to the powdered drug chamber through the opening.

In a forty-seventh aspect of the present disclosure, which may be combined with any other aspect unless specified otherwise, a container forming and filling method includes: forming at least one strong seal around a periphery of first and second sheets so as to leave an opening between the first and second sheets; forming a temporary peel seal across the opening; injecting gas through the temporary peel seal to separate the first and second sheets; pulling the separated first and second sheets to open the temporary peel seal in an aseptic environment; adding powdered drug to the multiple chamber container through the opening; and strong sealing the opening so as to be closed.

In a forty-eighth aspect of the present disclosure, which may be combined with the forty-seventh aspect in combination with any other aspect unless specified otherwise, injecting gas through the temporary peel seal includes providing a smaller opening in the temporary peel seal and injecting the gas via the smaller opening.

In a forty-ninth aspect of the present disclosure, which may be combined with the forty-seventh aspect in combination with any other aspect unless specified otherwise, pulling the separated first and second sheets to open the temporary peel seal includes applying suction cups to the first and second sheets and pulling the suction cups apart.

In a fiftieth aspect of the present disclosure, which may be combined with the forty-seventh aspect in combination with any other aspect unless specified otherwise, the method includes forming an administration port, sealing the administration port between and to the first and second sheets, and sterilizing the multiple chamber container including the administration port.

In a fifty-first aspect of the present disclosure, which may be combined with the forty-seventh aspect in combination with any other aspect unless specified otherwise, injecting gas through the temporary peel seal between the first and second sheets is performed prior to sterilization of the container or in an aseptic environment.

In a fifty-second aspect of the present disclosure, which may be combined with any other aspect unless specified otherwise, a method is provided for a multiple chamber container including a diluent chamber, a drug chamber, an administration port, a first peel seal located between the diluent chamber and drug chamber, and a second peel seal located between the drug chamber and the administration port, the method including: filling the diluent chamber with diluent non-aseptically; sealing the diluent chamber completely; sterilizing the dual chamber bag including the diluent; filling the drug chamber aseptically with a presterilized drug; and sealing the drug chamber completely.

In a fifty-third aspect of the present disclosure, which may be combined with the fifty-second aspect in combination with any other aspect unless specified otherwise, sterilizing the dual chamber bag including the diluent includes steam sterilizing or radiation sterilizing the dual chamber bag.

In a fifty-fourth aspect of the present disclosure, which may be combined with the fifty-second aspect in combination with any other aspect unless specified otherwise, filling the drug chamber aseptically with a presterilized drug includes filling the drug chamber through the administration port.

In a fifty-fifth aspect of the present disclosure, which may be combined with the fifty-second aspect in combination with any other aspect unless specified otherwise, sealing the drug chamber completely includes sealing a seal forming the drug chamber.

In a fifty-sixth aspect of the present disclosure, which may be combined with the fifty-second aspect in combination with any other aspect unless specified otherwise, the method further includes applying a vacuum to the drug chamber prior to filling the drug chamber aseptically with the presterilized drug.

In a fifty-seventh aspect of the present disclosure, which may be combined with the fifty-second aspect in combination with any other aspect unless specified otherwise, the method further includes purging the drug chamber with an inert gas prior to filling the drug chamber aseptically with the presterilized drug.

In a fifty-eighth aspect of the present disclosure, which may be combined with the fifty-second aspect in combination with any other aspect unless specified otherwise, wherein filling the drug chamber aseptically with the presterilized drug and sealing the drug chamber completely occurs before filling the diluent chamber with diluent non-aseptically, sealing the diluent chamber completely, and sterilizing the dual chamber bag including the diluent.

In a fifty-ninth aspect of the present disclosure, which may be combined with any other aspect unless specified otherwise, a multiple chamber container forming and filling method includes: forming at least one strong seal around a periphery of first and second sheets so as to leave first and second openings between the first and second sheets; forming a first temporary peel seal across the first opening; forming a second temporary peel seal across the second opening; forming a mixing peel seal between the first and second sheets so as to separate a powdered drug chamber from a diluent chamber; opening the first temporary peel seal in an aseptic environment; adding powdered drug to the powdered drug chamber through the first opening; strong sealing the first opening so as to be closed; opening the second temporary peel seal in an aseptic environment; adding diluent to the diluent chamber through the second opening; and strong sealing the second opening so as to be closed.

In a sixtieth aspect of the present disclosure, which may be combined with the fifty-ninth aspect in combination with any other aspect unless specified otherwise, the method includes forming a delivery peel seal between the powdered drug chamber and an outlet of the multiple chamber container.

In a sixty-first aspect of the present disclosure, which may be combined with the fifty-ninth aspect in combination with any other aspect unless specified otherwise, the method includes at least one of (i) extending the first opening and the first temporary peel seal along the powdered drug chamber or (ii) extending the second opening and the second temporary peel seal along the diluent chamber.

In a sixty-second aspect of the present disclosure, which may be combined with the fifty-ninth aspect in combination with any other aspect unless specified otherwise wherein at least one of (i) forming the first temporary peel seal across the first opening includes leaving a smaller opening in the first temporary peel seal to accept a gas injecting structure or (ii) forming the second temporary peel seal across the second opening includes leaving a smaller opening in the second temporary peel seal to accept a gas injecting structure.

In a sixty-third aspect of the present disclosure, which may be combined with the fifty-ninth aspect in combination with any other aspect unless specified otherwise, the method includes closing at least one of the smaller openings after inserting gas through the at least one smaller opening.

In a sixty-fourth aspect of the present disclosure, which may be combined with the fifty-ninth aspect in combination with any other aspect unless specified otherwise, the method includes inserting gas into at least one of the powdered drug chamber or the diluent chamber prior to opening the temporary peel seal.

In a sixty-fifth aspect of the present disclosure, which may be combined with the sixty-fourth aspect in combination with any other aspect unless specified otherwise, the gas is at least one of an inerting gas or an oxygen getting gas.

In a sixty-sixth aspect of the present disclosure, which may be combined with the sixty-fourth aspect in combination with any other aspect unless specified otherwise, the gas separates the first and second sheets, and wherein opening at least one of the first or second temporary peel seals includes suctioning the separated first and second sheets and pulling on the at least one of the temporary peel seals.

In a sixty-seventh aspect of the present disclosure, which may be combined with any other aspect unless specified otherwise, a container forming and filling method includes: forming at least one strong seal around a periphery of first and second sheets so as to leave first and second openings between the first and second sheets; forming first and second temporary peel seals across the first and second openings, respectively; injecting gas through the first and second temporary peels seal to separate the first and second sheets; pulling the separated first and second sheets to open the first and second temporary peel seals in an aseptic environment; adding powdered drug through the first opened temporary peel seal; adding diluent through the second opened temporary peel seal; and strong sealing the opened first and second temporary peel seals so as to be closed.

In a sixty-eighth aspect of the present disclosure, which may be combined with the sixty-seventh aspect in combination with any other aspect unless specified otherwise, injecting gas through the first and second temporary peel seals includes providing a smaller opening in each of the first and second temporary peel seals and injecting the gas via the smaller openings.

In a sixty-ninth aspect of the present disclosure, which may be combined with the sixty-seventh aspect in combination with any other aspect unless specified otherwise, pulling the separated first and second sheets to open the first and second temporary peel seals includes (i) applying first suction cups to the first and second sheets adjacent the first temporary peel seal and pulling the first suction cups apart and (ii) applying second suction cups to the first and second sheets adjacent the second temporary peel seal and pulling the second suction cups apart.

In a seventieth aspect of the present disclosure, which may be combined with the sixty-seventh aspect in combination with any other aspect unless specified otherwise, the method includes forming an administration port, sealing the administration port between and to the first and second sheets, and sterilizing the multiple chamber container including the administration port.

In a seventy-first aspect of the present disclosure, which may be combined with the sixty-seventh aspect in combination with any other aspect unless specified otherwise, injecting gas through the first and second temporary peel seals is performed prior to sterilization of the container or in an aseptic environment.

Moreover, any of the structure, functionality and alternatives disclosed in connection with FIGS. 1A to 13 and the claims below may be combined with any of the other structure, functionality and alternatives disclosed in connection with FIGS. 1A to 13 and the claims. For example, different aspects of the flexible container, flexible container product and flexible container methods recited in the claims below may be combined with each other, and wherein the resulting combinations are expressly contemplated as being within the scope of the present disclosure.

In light of the present disclosure including the above aspects, it is therefore an advantage of the present disclosure to provide an improved dual chamber bag.

It is another advantage of the present disclosure to provide an improved dual chamber bag, which virtually guarantees that patients will receive a properly mixed drug.

It is a further advantage of the present disclosure to provide improved ways of loading and sterilizing the contents of dual chamber bags.

It is yet another advantage of the present disclosure to provide an improved way to distribute the components of drugs and diluent used to fill different compartments of a dual chamber bag.

The advantages discussed herein may be found in one, or some, and perhaps not all of the embodiments disclosed herein. It should also be appreciated that any numeric values, such as distances and force values, provided herein are for purposes of enablement by example only, and are in no way meant to be a required feature unless specifically recited in any of the claims. Additional features and advantages are described herein, and will be apparent from, the following Detailed Description and the figures.

DETAILED DESCRIPTION

Dual Chamber Container or Bag

Figure 1A:
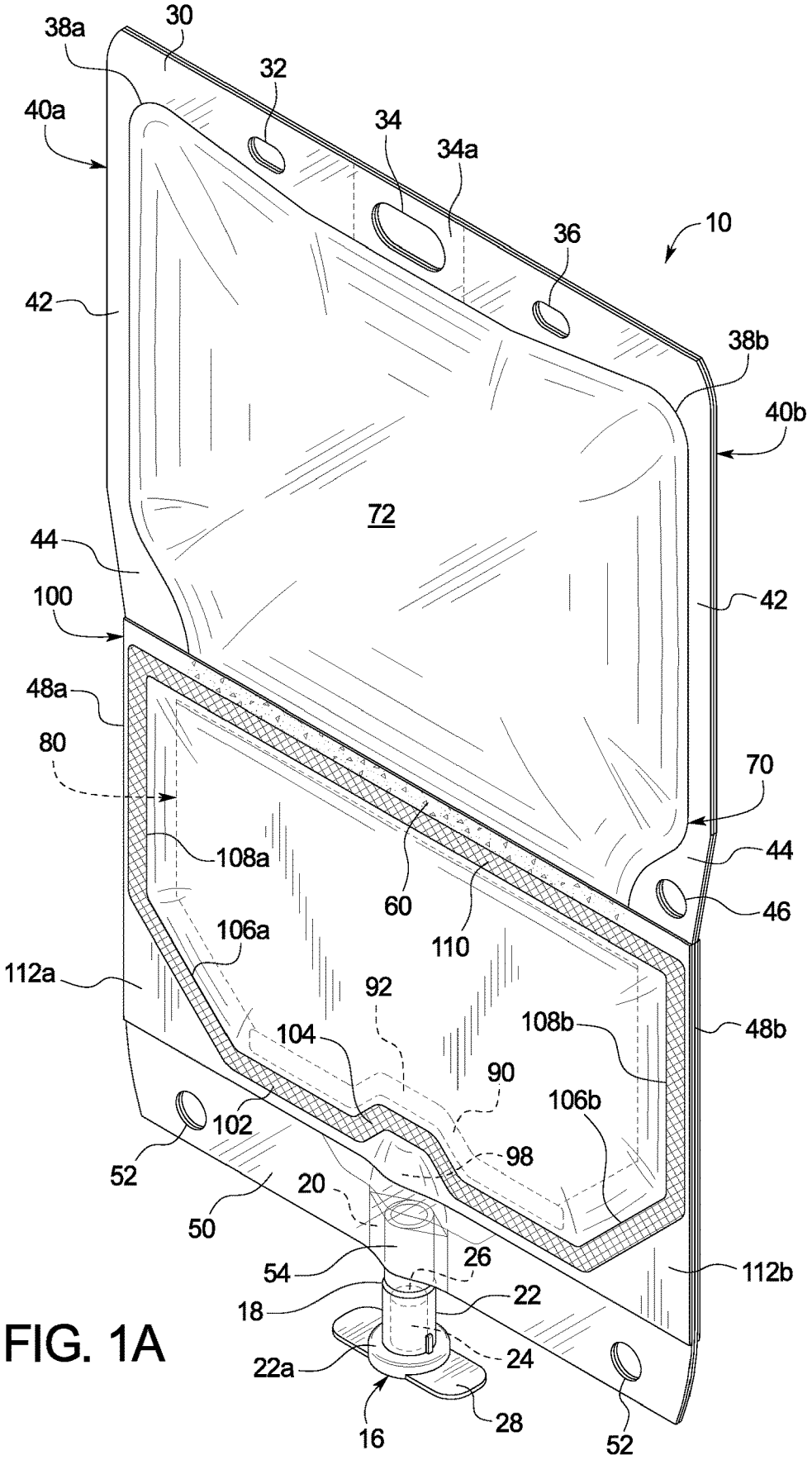
FIG. 1A is a top-front perspective view of one embodiment of a dual chamber container or bag of the present disclosure.

Referring now to the drawings, FIGS. 1A to 9 illustrate various embodiments of a dual chamber container or bag 10. Dual chamber bag 10 includes a first sheet 12 sealed to a second sheet 14. Sheets 12 and 14 may each be made of a single layer or may instead include two or more layers laminated together or coextruded. For example, sheets 12 and 14 may each have three layers including a seal layer (closest to diluent and drug), a middle layer, and a skin layer (outer layer). The seal layer may include a compound of homo polypropylene ("homo PP") and a propylene-ethylene copolymer ("EPR"), wherein amorphous domain EPR is finely dispersed in a homo PP matrix. The middle layer may include a compound of homo PP with a styrene elastomer (e.g., styrene ethylene butylene styrene ("SEBS") or styrene ethylene propylene styrene ("SEPS")). The skin layer may include a compound of homo PP and EPR, wherein the EPR is finely dispersed in a homo PP matrix, and wherein the content of EPR may be less than that of the seal layer.

For purposes of illustration only, dual chamber bag 10 will be described in terms of how it is to be arranged for use with its administration port 16 located at the bottom of the bag and extending downwardly to aid gravity flow. Upper seam 30 is formed having a strong seal. A strong seal as used herein is a seal that will not rupture under the force applied by a user to open any of the peel seals discussed herein. In an embodiment, any strong seal discussed herein may have a seal strength of at least about 30 N/15 mm. A user will be instructed to press or roll bag 10 at a location containing the diluent to build fluid pressure to rupture the peel seals. A strong seal as used herein will not rupture under such fluid pressure. The seals of any of the seams discussed herein are typically sealed via heat sealing. Seal strength may be varied by controlling the seal temperature, for example.

In a non-limiting example, upper seam 30 is a relatively wide seam, which may have a widest width from about 12 millimeters ("mm") to about 25 mm, and which in one example instance is 18 mm. The length of upper seam 30 may be from about 150 mm to about 180 mm, and in one embodiment is 165 mm (the width of seam 30 may therefore be 10% to 11% of the length of the seam in one embodiment). The width of upper seam 30 as illustrated provides room and strength against tearing for one or more aperture 32, 34 and 36 formed in upper seam 30, which may be circular or oblong as illustrated. Aperture 34 may be used to hang bag 10 from an intravenous ("IV") stand or pole, while apertures 32 and 36 may be used to position bag 10 for either one or both of sterilization and/or filling. In the illustrated embodiment, seam 30 is narrowed and rounded at corners 38*a* and 38*b* of diluent chamber 70, to (i) increase the internal volume of and (ii) avoid sharp corners for chamber 70.

In an embodiment, upper seam at area 34*a* around oval 34 is reinforced either with additional material and/or additional sealing energy and/or additional sealing time. Reinforced area 34*a* helps to hold the entire weight of completely full bag 10 without tearing. Area 34*a* around oval 34 may include an additional piece of polymer material, which is welded to the rest of upper seam 30 to seal an aperture that allows diluent chamber 70 to be filled with liquid diluent.

Side seams 40*a* and 40*b* in an embodiment are generally mirror images of each other and are numbered the same accordingly. Side seams 40*a* and 40*b* extend from upper seam 30 and, like seam 30, are formed having strong seals. Side seams 40*a* and 40*b* each include a narrow portion 42, which extends along the majority of the corresponding side of diluent chamber 70. In a non-limiting example, narrow portion 42 may have a width of about 4 mm to about 10 mm, and in one example instance is 6 mm. The length of narrow portion 42 will vary depending upon the size of bag 10, which may in non-limiting examples be provided in three different sizes, such as, a 100 milliliter ("mL") diluent bag 10, a 100 mL diluent bag, a 200 mL diluent bag, and a 400 mL diluent bag. Different or additional sizes may also be provided, e.g., less than 100 mL and/or greater than 400 mL.

Narrow portions 42 of side seams 40*a* and 40*b* extend to curved or angled corners 44, which increase the strong sealed area in a rounded, elliptical, parabolic or triangular way. Curved or angled corners 44 provide room and strength for one or more aperture 46, e.g., circular aperture, if desired, which may also be used to position bag 10 for either one or both of sterilization and/or filling. Curved or angled corners 44 also funnel diluent within diluent chamber 70 towards a mixing peel seal 60 discussed in detail below. Funneling diluent towards mixing peel seal 60 helps to maximize the seal opening pressure per force applied by the user.

Powdered drug portions 48*a* and 48*b* of side seams 40*a* and 40*b*, respectively, extend from curved or angled corners 44 of the side seams to a bottom seam 50. In a non-limiting example, powdered drug portions 48*a* and 48*b* of the side seams may be from about 5 mm to about 12 mm wide, and in one example instance may be 10 mm wide. In a non-limiting example, the lengths of powdered drug portions 48*a* and 48*b* of the side seams extending from curved or angled corners 44 to bottom seam 50 may each be about 100 mm to about 120 mm. As discussed, narrow portions 42, curved or angled corners 44, and powdered drug portions 48*a* and 48*b* of side seams 40*a* and 40*b*, respectively, are each formed having strong seals.

Bottom seam 50 is likewise a strong seam and in a non-limiting example may be from about 145 mm long to about 170 mm long, and in one example instance may be 155 mm long. Bottom seam 50 may therefore be longer or shorter than upper seam 30. The width of bottom seam 50 varies due to the shape of powdered drug chamber 80 and the shape of an administration area 98 located between drug chamber 80 and administration port 16. In an embodiment, the width of bottom seam 50 is greatest at the corners of bottom seam 50, which may include or define apertures 52 that may be used to position bag 10 for sterilization and/or filling, while the width of bottom seam 50 is smallest at its center section 54, which is sealed to administration port 16.

Administration port 16 in the illustrated embodiment includes a hollow port body 18, which may be a molded, e.g., injection molded, rigid PP structure. Administration port 16 includes a port body 18 having a tapered sealing portion 20 that extends to a cylindrical outlet portion 22, which resides outside of bag 10. Tapered sealing portion 20 is sealed between sheets 12 and 14 at center section 54 of seam 50, e.g., via ultrasonic welding, heat sealing, solvent bonding, and the like. The tapered shape of sealing portion 20 prevents sheets 12 and 14 at center section 54 from having to form a sharp radius to seal around a circular port section, which could lead to a faulty seal. Outlet portion 22 of port body 18 includes a flange 22*a* at its end for receiving a spike from a mating administration set and to provide an increased area for sealing to a tear strip 28.

In the illustrated embodiment, a compliant or compressible insert or sleeve 24 is fitted sealingly inside outlet portion 22 and flange 22*a* of administration port 16, and may be formed within the port via successive molding steps. Insert or sleeve 24 may be formed from a medically safe rubber, e.g., a thermoplastic elastomer ("TPE"), which accommodates a broad range of spike head diameters provided with the administration sets. Rubber insert 24 provides flexibility, e.g., compressibility, to accept standard sized diameter spikes and non-standard or differently sized spikes. Outlet portion 22 of administration port 16 may be formed, e.g., injection molded, with a membrane 26, which is pierced by the spike of the administration set to enable the reconstituted drug within bag 10 to flow to the patient. In an alternative embodiment, membrane 26 may be formed instead with insert 24. A thin plastic tear strip 28 includes a middle section that is peel sealed to flange 22*a* of outlet portion 22, maintaining sterility and preventing contaminants from entering and contacting rubber insert 24, wherein such contaminants could be carried into the interior of bag 10 upon spiking. Either exposed end of tear strip 28 may be grasped by the user to tear strip 28 from flange 22*a* for spiking membrane 26 of administration port 16.

Figure 1B:
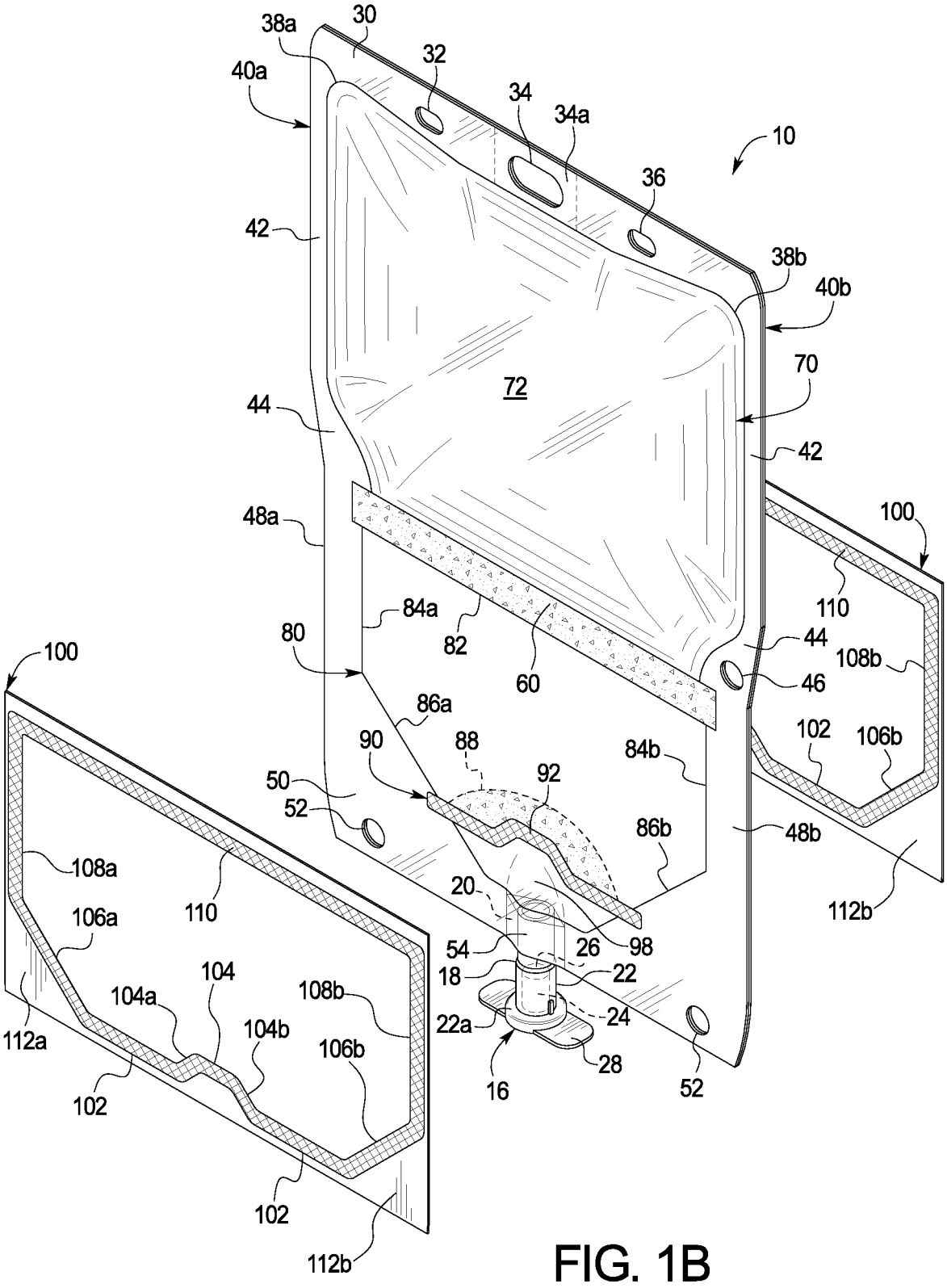
FIG. 1B is a top-front perspective view of the dual chamber bag of FIG. 1A showing opaque cover layers exploded or removed from the sheets of the container or bag.

FIG. 1B perhaps best illustrates that a mixing peel seal 60 is located between diluent chamber 70 and powdered drug chamber 80. In one embodiment, the width of mixing peel seal 60 is from about 10 mm to about 20 mm, and is in one embodiment 15 mm. The length of peel seal 60 may extend from (i) curved or angled corner 44 to curved or angled corner 44 of side seams 40*a* and 40*b* or (ii) powdered drug portion 48*a* to powdered drug portion 48*b* of side seams 40*a* and 40*b*, respectively. The force needed to open peel seal 60 in one embodiment is roughly one-quarter to one-third of the force needed to separate any of upper seam 30 or narrow portions 42 of side seams 40*a* and 40*b*, forming the remainder of diluent chamber 70. In an embodiment, the strength of mixing peel seal 60 may be about 2 to 12 N/15 mm. Mixing peel seal 60 is sufficiently strong and liquid-tight to prevent diluent in diluent chamber 70 from flowing into powdered drug chamber 80.

Diluent chamber 70 as mentioned above may be sized differently in non-limiting examples to hold different maximum amounts of diluent, e.g., 100 mL, 200 mL or 400 mL. In a non-limiting example, diluent chamber 70 may have a side-to-side width from about 140 mm to about 160 mm, and in one example instance a width of 153 mm. In a non-limiting example, diluent chamber 70 may have a top (starting from area 34*a* around oval 34) to bottom height ranging from about 70 mm to about 170 mm. Diluent chamber 70 as illustrated in FIGS. 1A to 4 includes a pouch 72 formed from sheets 12 and 14, which may be preformed or which may be formed when diluent is added. In one embodiment, even when pouch 72 is filled with diluent, sheets 12 and 14 are at least substantially upstretched. In an embodiment, pouch 72 is not filled completely with diluent. Thus, a diluent chamber 70 capable of holding 100 mL, for example, may be filled with only 50 or 75 mL, and likewise for the 200 mL and 400 mL larger diluent chambers 70, to provide a desired amount of diluent for dissolving and delivering the drug in drug chamber 80.

Powdered drug chamber 80 is located on the other side of mixing peel seal 60 from diluent chamber 70. Powdered drug chamber 80 is sized to hold enough powdered drug to provide any feasible drug dose to the patient based upon the volume of diluent provided in diluent chamber 70. In a non-limiting example, powdered drug chamber 80 may have a side to side (inner edges of side 84*a* to inner edge of side 84*b*) width from about 130 mm to about 150 mm, and in one example instance have a width of 140 mm. In one non-limiting example, powdered drug chamber 80 may have a top (at mixing peel seal 60) to bottom (at delivery peel seal 90) height ranging from about 70 mm to about 170 mm.

In the illustrated embodiment, powdered drug chamber 80 includes an upper edge 82 formed by mixing peel seal 60, and two sides 84*a* and 84*b* formed by powdered drug portions 48*a* and 48*b*, respectively, of side seams 40*a* and 40*b*, which extend perpendicular to upper edge 82. Powdered drug chamber 80 in the illustrated embodiment also includes two angled sides 86*a* and 86*b* formed by bottom seam 50, which extend to center section 54 sealed to administration port 16 of bottom seam 50. The two angled sides 86*a* and 86*b* are interrupted by delivery peel seal 90 to form the lower edge of powdered drug chamber 80. Powdered chamber 80 may be evacuated or purged with inert gas before filling to prevent air from contacting the drug. In FIG. 1B, with dual chamber bag 10 hanging in the operable position such that administration port 16 points downwardly, a powdered drug 88 due to gravity falls due to gravity so as to rest on the top of delivery peel seal 90.

Drug 88 may be any powdered drug capable of dissolving with a diluent, including but not limited to (i) powdered drug preparations for the prevention and treatment of viral diseases, auto-immune and inflammatory diseases, cardiovascular and pulmonary diseases, central nervous system diseases, peripheral neurological system diseases, pain, dermatologic diseases, gastro-intestinal diseases, infectious-related diseases, metabolic diseases, oncologic diseases, ophthalmic diseases, respiratory diseases, digital ulcers, and cerebrovascular diseases, (ii) vaccines, (iii) anxiolytics, (iv) anti-allergics, and (v) anti-infectives.

In a non-limiting example, delivery peel seal 90 may be about 3 mm to about 10 mm wide and about 50 mm to about 90 mm long and have the same seal strength (force required to open), greater seal strength or a lower seal strength than mixing peel seal 60. In an embodiment, peel seal 90 may have a seal strength of approximately 2 to 10 N/15 mm, which is the same or lower than the seal strength of mixing peel seal 60. Delivery peel seal 90 in the illustrated embodiment has a non-linear shape, such as a trapezoidal shape. In any case, delivery peel seal 90 includes a central portion 92 that extends around an administration area 98 located between sheets 12 and 14 and directly adjacent to tapered sealing portion 20 of administration port 16, which is sealed to center section 54 of bottom seam 50. Placing central portion 92 instead closer to tapered sealing portion 20 runs the risk of inducing stress on peel seal 90 at portion 92 due to the sealing of sheets 12 and 14 to administration port 16, which may cause peel seal 90 to open inadvertently. Trapezoidally or otherwise extended central portion 92 of delivery peel seal 90 ensures that the peel seal 90 is not activated under stress until the user applies pressure via mixed drug and diluent.

One aspect of the present disclosure is how chambers 70 and 80 interact during use via peel seals 60, 90/92 to help ensure that the opening mechanics of the dual chamber bag 10 are easy and fool proof. For example, (i) diluent and powdered drug 88 always mix before use, (ii) container 10 does not require a large manual effort to activate, and (iii) the sealing is nonetheless strong enough to withstand normal transportation and handling. Non-linear or trapezoidal portion 92, in addition to avoiding administration port 16, creates a stress concentration which in combination with the relative seal strengths of peel seals 60 and 90 help to meet the above-listed operational goals. Again, portion 92 may have any desired non-lineal shape.

As discussed, one primary purpose for the shape of non-linear portion 92 of peel seal 90 is to space peel seal 90 at portion 92 away from tapered sealing portion 20, so that the tapered extended portion 92 is not placed under undue stress, which might cause the seal to begin to open. In the illustrated embodiment, an opaque removable cover layer 100 may be applied to one or both of sheets 12 and 14 to cover powdered drug chamber 80 and administration area 98 beneath central portion 92 of delivery peel seal 90. Opaque layers 100 may have the same side-to-side length as the length of bottom seam 50 and extend in height from a top (or above) mixing peel seal 60 downwardly past delivery peel seal 90. A bottom seal 102 of opaque layer 100, in the illustrated embodiment, has the same non-linear or trapezoidal shape as peel seal 90, including a jutting or trapezoidal portion 104 that matches portion 92 of peel seal 90. In this manner, the existence of tapered sealing portion 20 of administration port 16 does not adversely affect bottom seal 102 of opaque layer 100, e.g., by placing stress on the seal.

Figure 2:
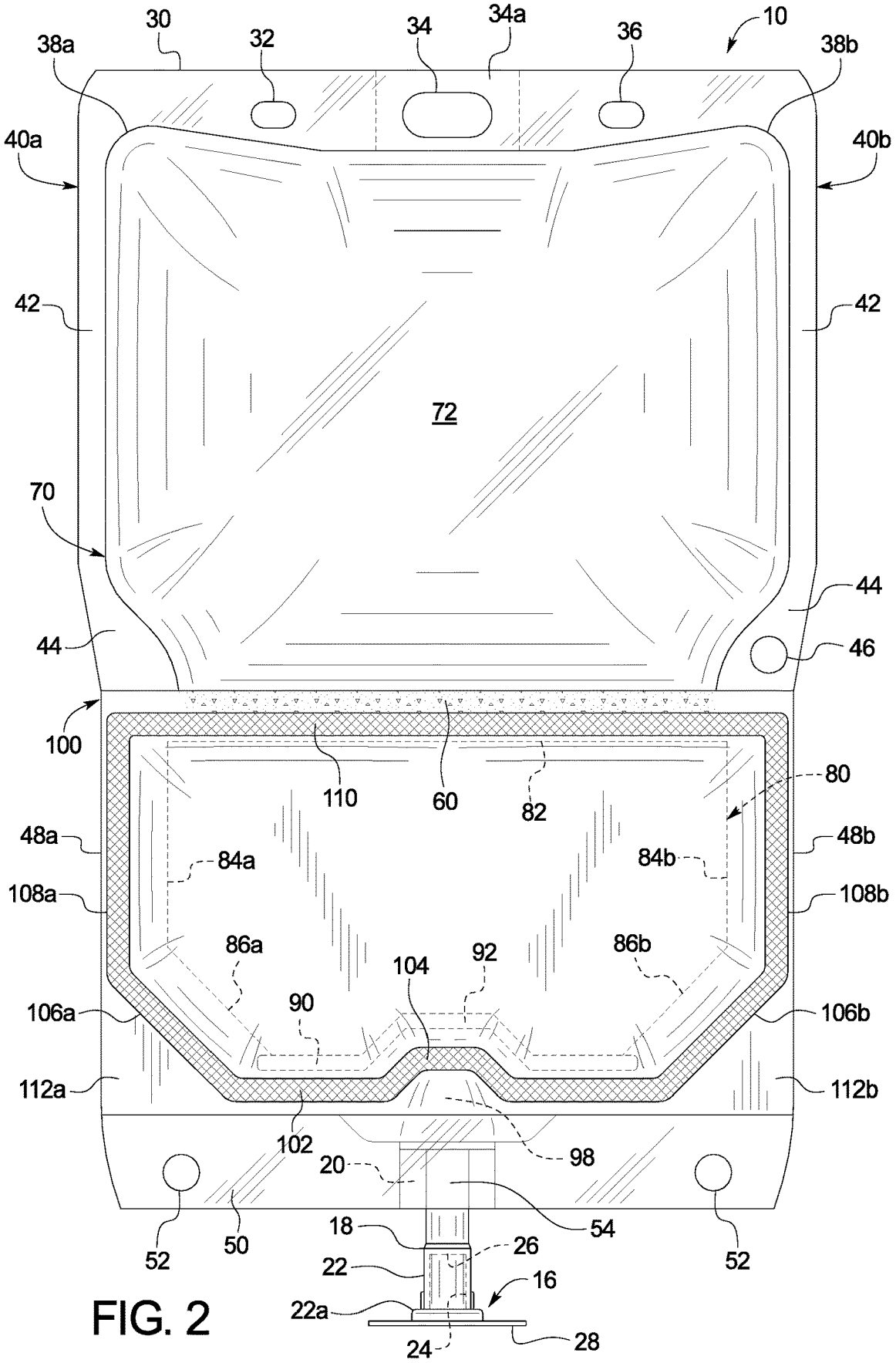
FIG. 2 is a front view of the dual chamber container or bag of FIGS. 1A and 1B.
Figure 3:
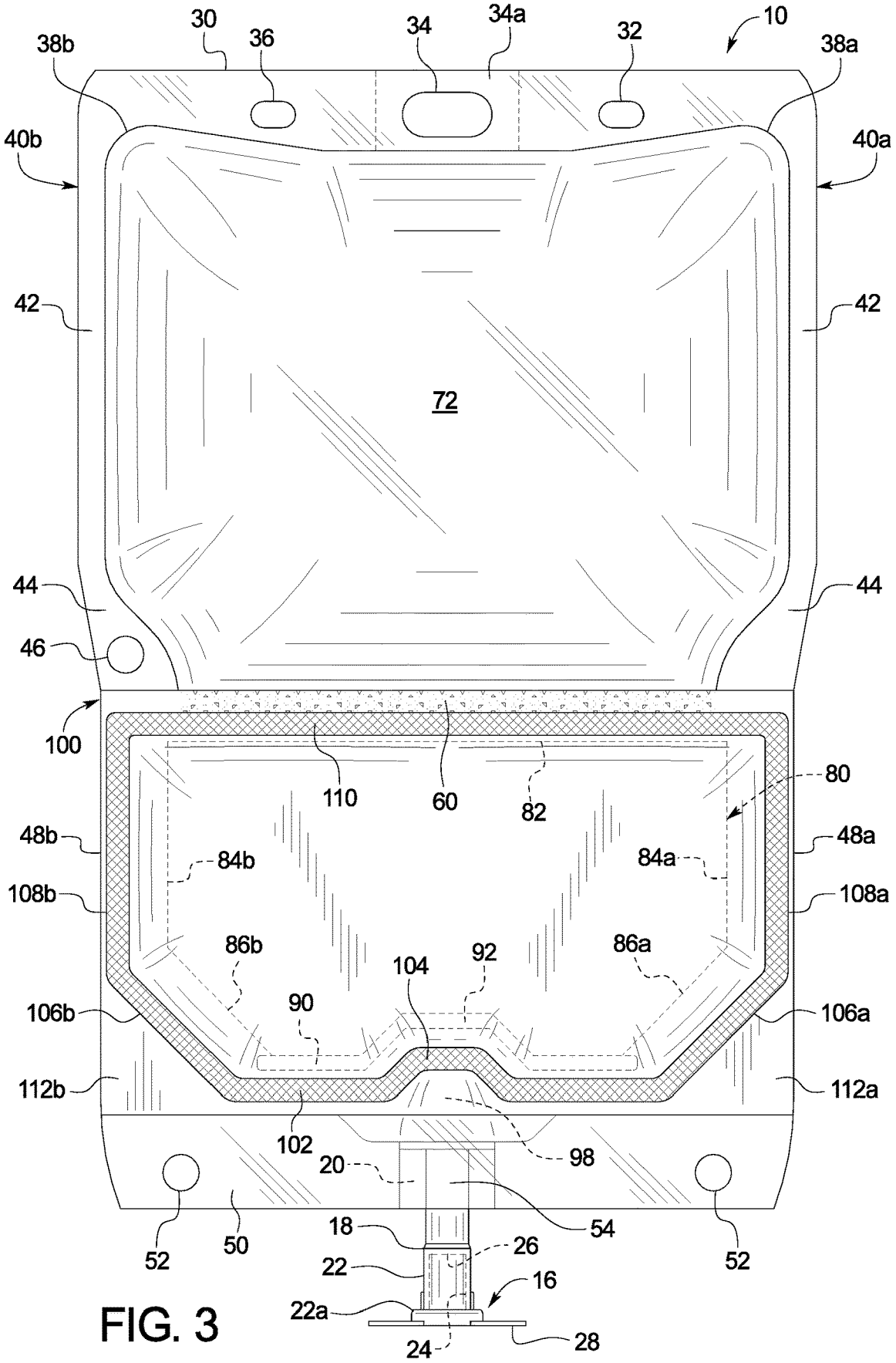
FIG. 3 is a rear view of the dual chamber container or bag of FIGS. 1A and 1B.
Figure 4:
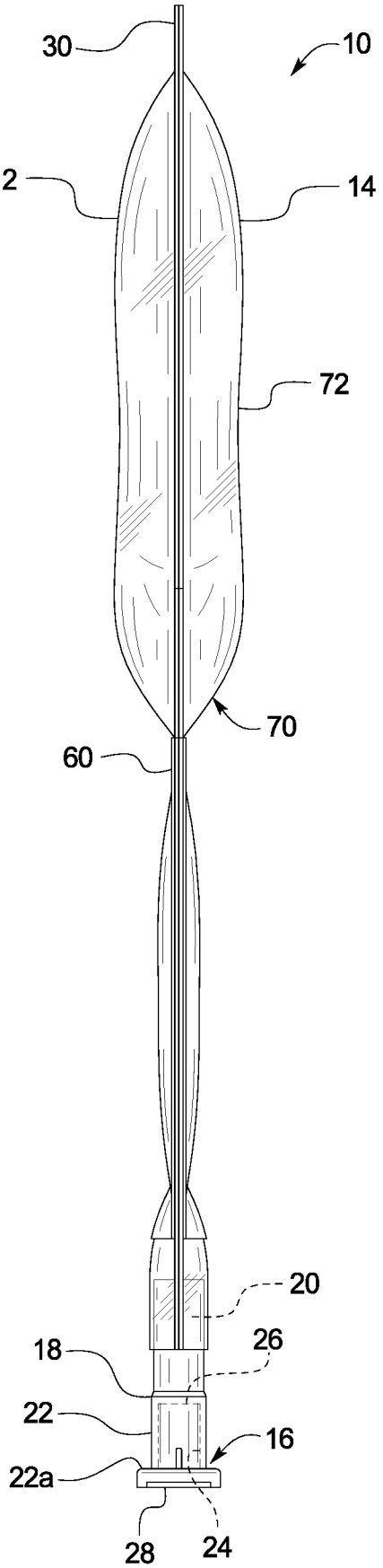
FIG. 4 is a side view of the dual chamber container or bag of FIGS. 1A and 1B.
Figure 5:
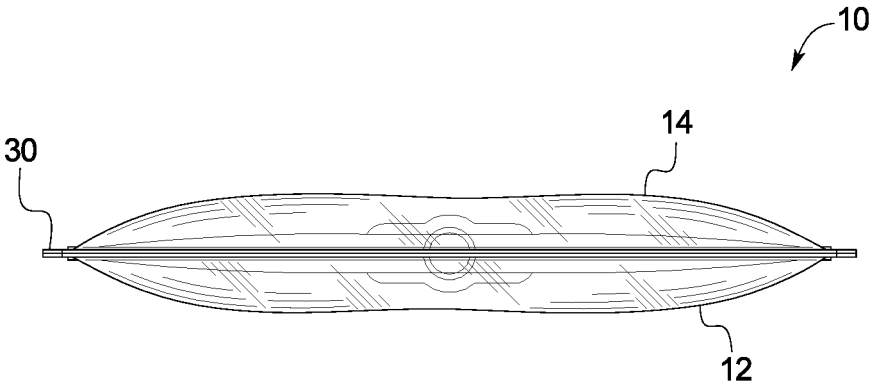
FIG. 5 is a top plan view of the dual chamber container or bag of FIGS. 1A and 1B.
Figure 6:
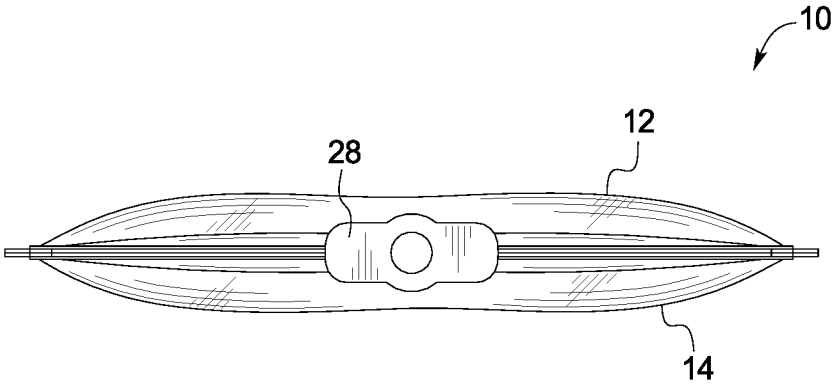
FIG. 6 is a bottom plan view of the dual chamber container or bag of FIGS. 1A and 1B.

In one embodiment illustrated in FIGS. 1A, 2 and 3, bottom seal 102 is located between delivery peel seal 90 and tapered sealing portion 20 of administration port 16. Trapezoidal portion 104 of bottom seal 102 may overlay a portion of administration area 98. Placing trapezoidal portion 104 of bottom seal 102 in such a location prevents bottom seal 102 from interfering (e.g., due to the formation of seal 102) with delivery peel seal 90 or powdered drug chamber 80. It should be appreciated that the location of trapezoidal portion 104 may cause peel seal 90 at portion 92 to be spaced further way from tapered sealing portion 20 of administration port 16. In an alternative embodiment discussed below, bottom seal 102 of opaque layers 100 may overlie delivery peel seal 90.

Opaque layers 100 illustrated in FIG. 1B may be of the same size and material, e.g., a polymer-coated aluminum foil, although the front and back layers 100 may have different markings and/or indicia. In the illustrated embodiment, bottom seal 102 of opaque layers 100 extends to angled seals 106*a* and 106*b* that extend along the widening portions of strong bottom seam 50. Side seals 108*a* and 108*b* extend from angled seals 106*a* and 106*b* along powdered drug portions 48*a* and 48*b* of side seams 40*a* and 40*b*, respectively, and in one embodiment such that opaque layers 100 completely cover drug portions 48*a* and 48*b* of the side seams. A top seal 110 of opaque layers 100 extends along mixing peel seal 60 and in one embodiment such that opaque layers 100 completely cover the mixing peel seal. All seals of opaque layers 100 are peel seals in one embodiment so that opaque layers 100 may be removed completely from container or bag 10 prior to reconstitution.

Opaque layers 100 extend past angled seals 106*a* and 106*b* to form tabs 112*a* and 112*b* that hinge up respectively from angled seals 106*a* and 106*b*. The user may grasp either of tabs 112*a* and 112*b* to remove opaque layers 100 from sheets 12 and 14. Seals 102, 106*a*, 106*b*, 108*a*, 108*b* and 110 may be formed by heat sealing at a lower temperature than that used to form peel seals 60 and 90. Opaque layers 100 protect the powdered drug in powdered drug chamber 80 from harmful ultraviolet ("UV") radiation and help to prevent air from entering chamber 80 through sheets 12 and 14.

Figure 7A:
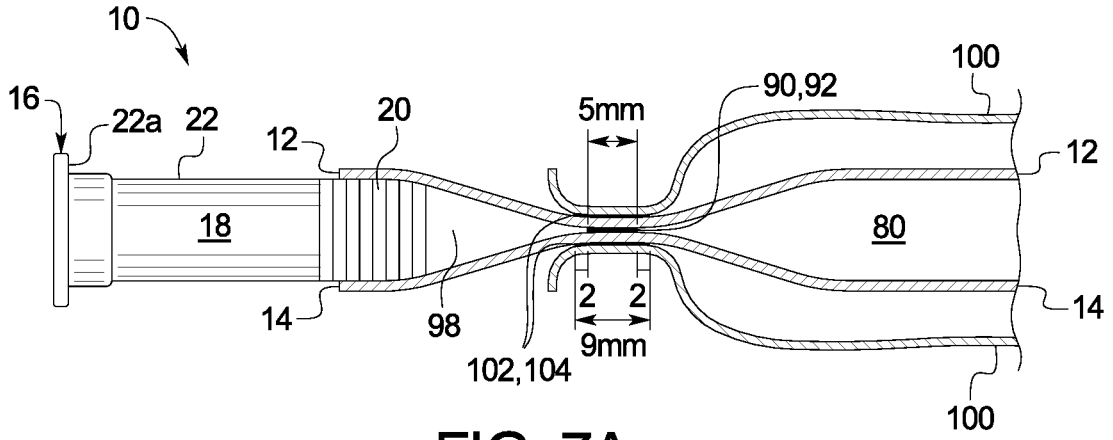
FIGS. 7A to 7C are partially sectioned side views of the dual chamber container or bag illustrating one embodiment for a relative location between a delivery peel seal and opaque cover peel seals.
Figure 7B:
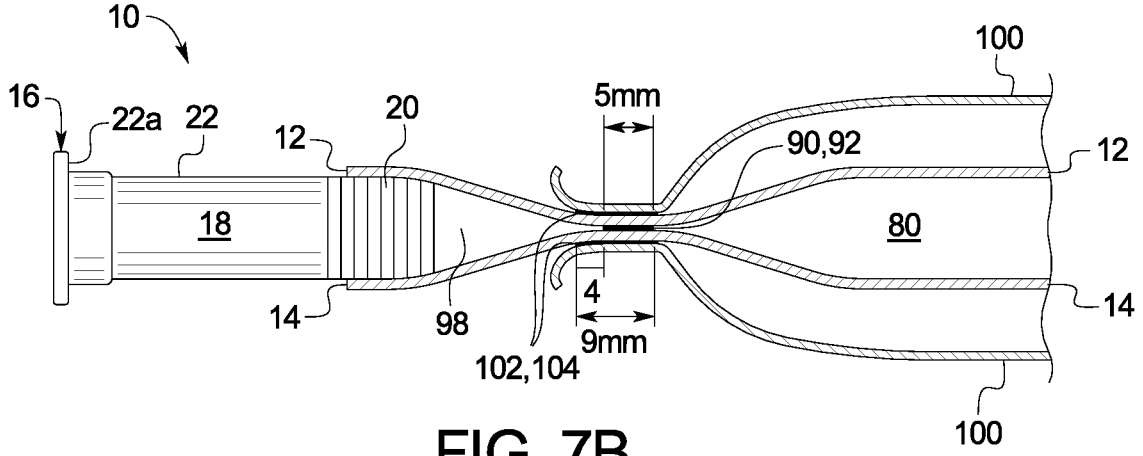
Figure 7C:
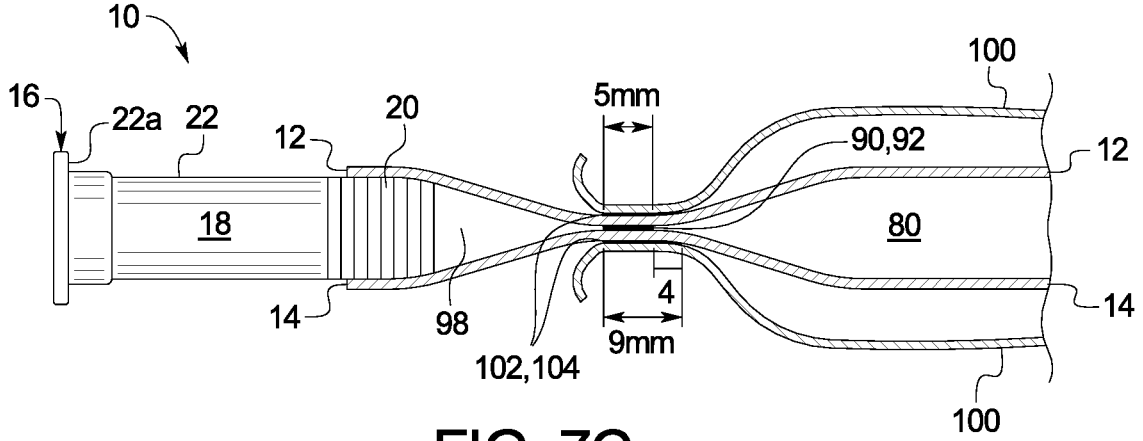

FIGS. 1A, 2 and 3 illustrate one embodiment for the relative placement between bottom seal 102 of opaque layers 100 and delivery peel seal 90 formed between sheets 12 and 14 of dual chamber bag 10. FIGS. 7A to 7C are side views of dual chamber bag 10 illustrating another embodiment for a relative placement between bottom seal 102 of opaque layers 100 and delivery peel seal 90 formed between sheets 12 and 14. In particular, a relative placement between jutting or trapezoidal portion 104 of bottom seal 102 of opaque layers 100 and non-linear or trapezoidal portion 92 of delivery peel seal 90 is illustrated. For reference, FIGS. 7A to 7C show many of the components of dual chamber bag 10 discussed above including sheets 12 and 14 sealed to administration port 16, wherein administration port 16 includes port body 18 having a tapered sealing portion 20 that extends to a cylindrical outlet portion 22. Tapered sealing portion 20 is sealed between and to sheets 12 and 14. Outlet portion 22 of port body 18 includes a flange 22*a* at its end for receiving a spike from a mating administration set and to provide an increased area for sealing to tear strip 28.

FIGS. 7A to 7C show opaque layers 100 separated from sheets 12 and 14 to help distinguish between same. In reality, opaque layers 100 directly abut sheets 12 and 14. The dimensions provided in FIGS. 7A to 7C are merely an example but do aptly illustrate one possible relationship between the different peel seals, wherein delivery peel seal 90 at extended portion 92 is 5 mm wide and bottom seal 102 at trapezoidal portion 104 is 9 mm wide. Delivery peel seal 90 and bottom seal 102 of opaque layers 100 may however be of any of the widths discussed above.

The goal in FIGS. 7A to 7C is for bottom seal 102 of opaque layers 100 to completely cover delivery peel seal 90. In FIG. 7A, the alignment between bottom seal 102 of opaque layers 100 and delivery peel seal 90 is perfect, wherein the same overshoot of 2 mm between bottom seal 102 and delivery peel seal 90 exists on both sides of delivery peel seal 90. The seal strengths (force required to open) of seals 102 and 90 will add to increase the overall force needed to open both seals. It is contemplated, however, to instruct the user to remove opaque layers 100 prior to activating either peel seal 60 or 90 of dual chamber bag. The user will then only have to provide the force needed to open delivery peel seal 90, e.g., 6 to 10 N/15 mm, to deliver the mixed drug.

In FIG. 7B, the misalignment of bottom seal 102 of opaque layers 100 to delivery peel seal 90 to the left is the most possible given the manufacturing process employed, wherein an overshoot of 4 mm between bottom seal 102 and delivery peel seal 90 exists to the left of delivery peel seal 90, while no overshoot exists to the right of delivery peel seal 90. Nevertheless, bottom seal 102 still completely covers delivery peel seal 90. Similarly in FIG. 7C, the misalignment of bottom seal 102 of opaque layers 100 to delivery peel seal 90 to the right is the most possible given the manufacturing process employed, wherein an overshoot of 4 mm between bottom seal 102 and delivery peel seal 90 exists to the right of the delivery peel seal 90, while no overshoot exists to the left of delivery peel seal 90. Here again, bottom seal 102 still completely covers delivery peel seal 90. It is accordingly contemplated in FIGS. 7A to 7C to size the width of bottom seal 102 and delivery peel seal 90 so that bottom seal 102 always covers delivery peel seal 90 regardless of manufacturing tolerance.

Figure 8A:
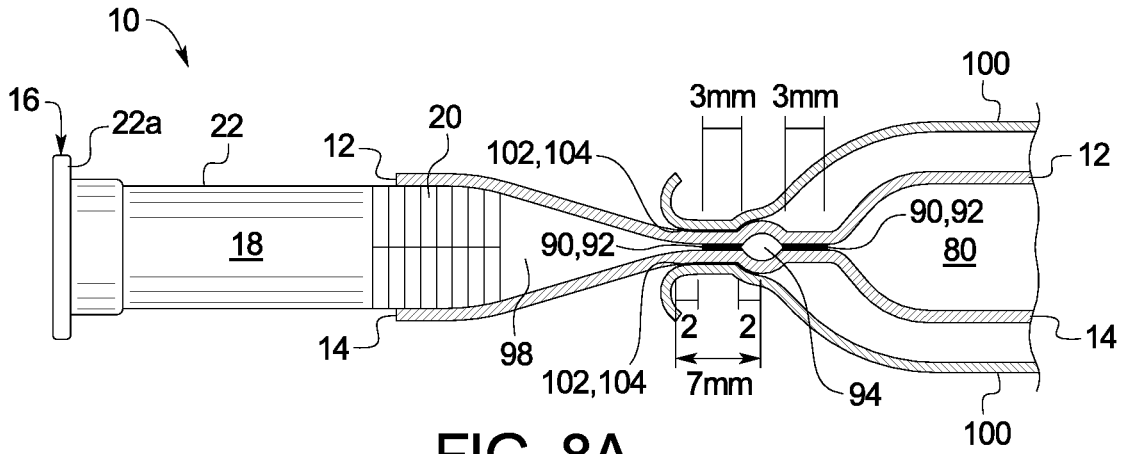
FIGS. 8A to 8C are partially sectioned side views of the dual chamber container or bag illustrating another embodiment for a relative location between multiple delivery peel seals and opaque cover peel seals.
Figure 8B:
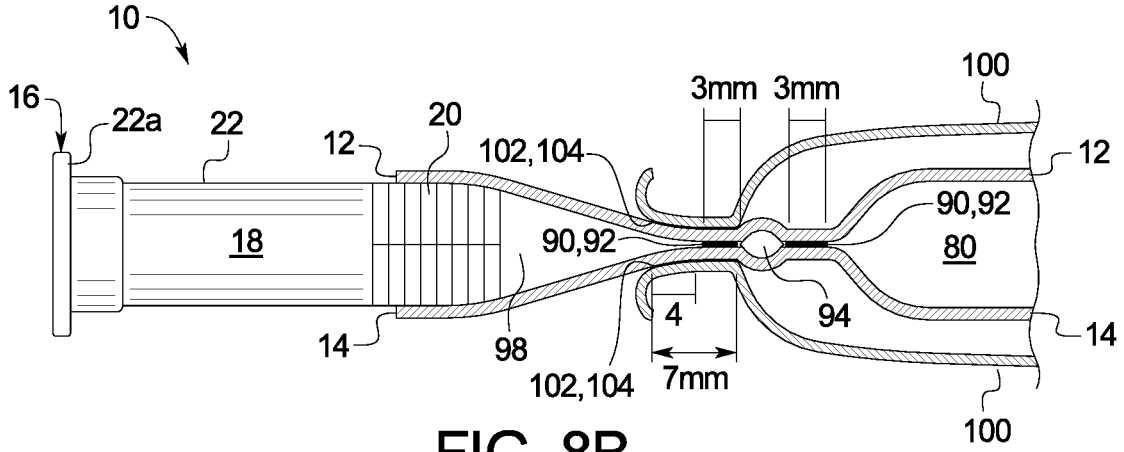
Figure 8C:
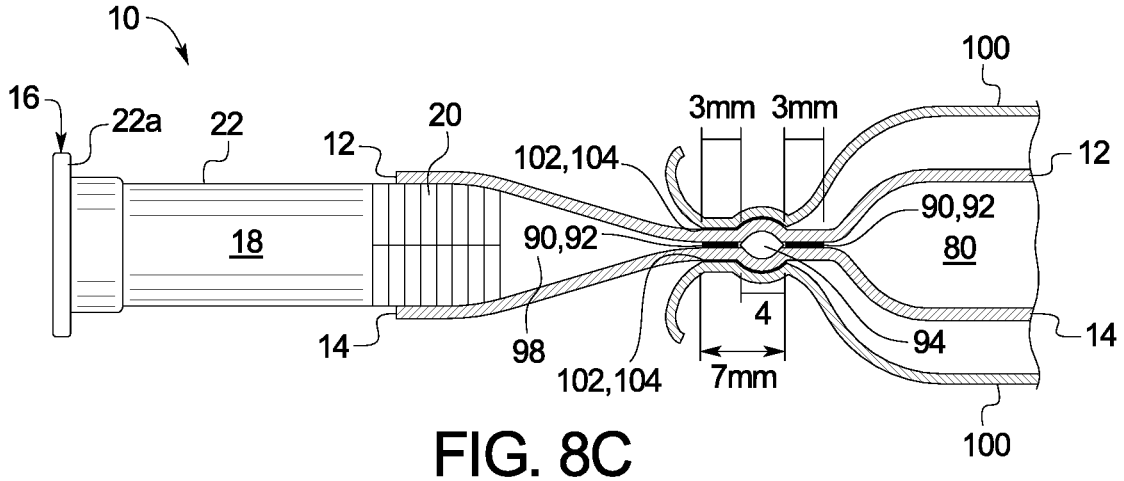

FIGS. 8A to 8C are side views of dual chamber bag 10 illustrating a further embodiment for a relative placement between bottom seal 102 of opaque layers 100 and, here, two delivery peel seals 90 formed between sheets 12 and 14. In particular, a relative placement between jutting or trapezoidal portion 104 of bottom seal 102 of opaque layers 100 and non-linear or trapezoidal portions 92 of two delivery peel seals 90 is illustrated. For reference, FIGS. 8A to 8C again show many of the components of dual chamber bag 10 discussed above including sheets 12 and 14 sealed to administration port 16, wherein administration port 16 includes port body 18 having a tapered sealing portion 20 that extends to a cylindrical outlet portion 22. Outlet portion 22 of port body 18 again includes a flange 22*a* at its end.

FIGS. 8A to 8C show opaque layers 100 separated from sheets 12 and 14 to help distinguish between same. Again, opaque layers 100 directly abut sheets 12 and 14 in the commercial embodiment of dual chamber bag 10. The dimensions provided in FIGS. 8A to 8C are merely an example but do aptly illustrate one possible relationship between the different peel seals, wherein both delivery peel seals 90 at extended portions 92 are 3 mm wide, while bottom seal 102 at trapezoidal portion 104 is 7 mm wide. Delivery peel seal 90 and bottom seal 102 of opaque layers 100 may, however, be of any of the widths discussed above.

In FIGS. 8A to 8C, first and second peel seals 90, each having a non-linear or trapezoidal portion 92, are spaced apart from each other by a non-sealed section 94 between sheets 12 and 14. In the illustrated embodiments, the combined width of both peel seals 90, 6 mm, in FIGS. 8A to 8C, is approximately the same as the width of peel seal 90, 5 mm, in FIGS. 7A to 7C. Thus, assuming the same amount of energy is imparted to form peel seals 90 in FIGS. 8A to 8C as the amount of energy imparted to form peel seal 90 in FIGS. 7A to 7C, the seal strength of the combined peel seals 90 in FIGS. 8A to 8C should be roughly equal to the seal strength of peel seal 90 in FIGS. 7A to 7C, namely, about 2 to 10 N/15 mm.

The goal in FIGS. 8A to 8C is for bottom seal 102 of opaque layers 100 to completely cover left delivery peel seal 90 but not at all cover right delivery peel seal 90. In FIG. 8A, the alignment between bottom seal 102 of opaque layers 100 and delivery peel seals 90 is perfect, wherein the same overshoot of 2 mm between bottom seal 102 and left delivery peel seal 90 exists on both sides of left delivery peel seal 90. Right peel seal 90 is not at all covered. As with FIGS. 7A to 7C, it is contemplated to instruct the user to remove opaque layers 100 prior to activating either peel seal 60 or 90 of dual chamber bag, so that only the force needed to open both delivery peel seals 90, e.g., 2 to 10 N/15 mm, is needed to deliver the mixed drug.

In FIG. 8B, the misalignment in the left direction between bottom seal 102 of opaque layers 100 and left delivery peel seal 90 is the most possible given the manufacturing process employed, wherein an overshoot of 4 mm in the left direction between bottom seal 102 and left delivery peel seal 90 exists, while no overshoot exists to the right of delivery peel seal 90. Nevertheless, bottom seal 102 still completely covers left delivery peel seal 90, while right delivery peel seal 90 remains completely uncovered by bottom seal 102.

Similarly in FIG. 8C, the misalignment in the right direction between bottom seal 102 of opaque layers 100 and left delivery peel seal 90 is the most possible given the manufacturing process employed, wherein an overshoot of 4 mm in the right direction between bottom seal 102 and left delivery peel seal 90 exists, while no overshoot exists to the left of left delivery peel seal 90. Nevertheless, bottom seal 102 still completely covers left delivery peel seal 90, while right delivery peel seal 90 remains completely uncovered by bottom seal 102. It is accordingly contemplated in FIGS. 8A to 8C to size the width of bottom seal 102 and left and right delivery peel seals 90 so that bottom seal 102 always covers left delivery peel seal 90, while right delivery peel seal 90 is always uncovered, regardless of manufacturing tolerance.

Figure 9:
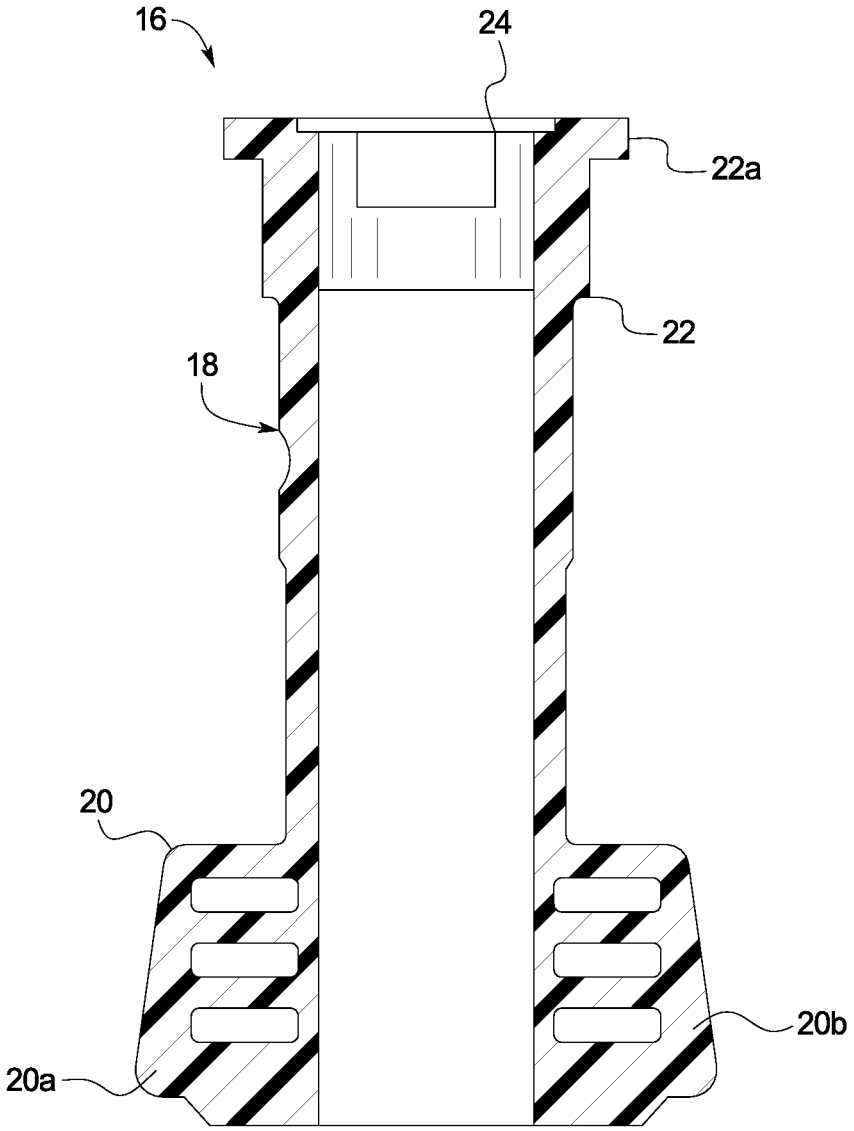
FIG. 9 is an elevation partial sectioned view of one embodiment of the administration port of the dual chamber container or bag of the present disclosure.

FIG. 9 illustrates one preferred embodiment for administration port 16, which is different in certain ways than administration port 16 discussed above. As before, administration port 16 includes port body 18 having a tapered sealing portion 20 forming flanges 20*a* and 20*b* (shown sectioned in FIG. 9), wherein tapered sealing portion 20 extends to a cylindrical outlet portion 22. Outlet portion 22 of port body 18 again includes a flange 22*a* for receiving tear strip 28 (illustrated above). Port body 18 is in one embodiment a molded, e.g., injection molded, rigid PP structure.

A compliant or compressible septum, insert or sleeve 24 is fitted sealingly inside outlet portion 22 and flange 22*a* of administration port 16. Septum 24 may be formed from a medically safe elastomer or rubber, e.g., a thermoplastic elastomer ("TPE"), which accommodates a broad range of spike head diameters provided with the administration sets. Septum 24 may be held in place within rigid outlet portion 22 via bonding, wherein the adhesion occurs in one embodiment via a two shot injection molding process such that the materials of both septum 24 and rigid portion 22 are injected into a same injection mold to increase the bonding between both materials. The resulting bi-injection molding bond is a cohesive bond. If rigid portion 22 and septum 24 are not molded together and are instead separate parts, an adhesive may be used to bond the separate parts together. Adhesion may also be obtained during the moist heat sterilization process. Septum 24 may be unslit and allow the spike of an administration set (not illustrated) to pierce the elastomeric septum 24, which holds the spike due to the resiliency of the material of septum 24. In an alternative embodiment, septum 24 is preslit.

Elastomeric septum 24 provides flexibility, e.g., compressibility, to accept standard sized diameter spikes and non-standard or differently sized spikes. One difference between administration set 16 of FIG. 9 and of the one described above is that a separate membrane 26 is not provided. Here, dual chamber bag 10 relies on the delivery peel seal 90 seal to separate septum 24 and port body 18 from powdered drug 88 prior to use.

In one embodiment, administration port 16 is fully assembled (including tear strip 28) prior to being sealed to sheets 12 and 14 of dual chamber container or bag 10, which in one embodiment is performed prior to the filling of diluent or powdered drug 88. In this way, sealed sheets 12 and 14 and sealed administration port 16 may be sterilized, e.g., steam sterilized, together. Here, tear strip 28 is configured to allow penetration of steam into port body 18, between strip 28 and septum 24 to sterilize all contacted surfaces.

Method of Making

Referring now to FIGS. 10A to 10D, dual chamber bag 10 is illustrated in various stages of manufacture. For purposes of illustration, opaque layers 100 are not shown. Also, only the element numbers relevant for FIGS. 10A to 10D are provided, however, each of the structure, functionality and alternatives discussed for any of the element numbers found in FIGS. 1A to 9 is applicable to dual chamber bag 10 of FIG. 10D (but missing opaque layers 100). FIGS. 10A to 10D illustrate certain differences with the bag version of FIGS. 1A to 6. One difference is that corners 44 in FIGS. 10A to 10D are angled instead of curved. Another difference is that an extra aperture 46 is formed in the version of FIGS. 10A to 10D.

Figure 10C:
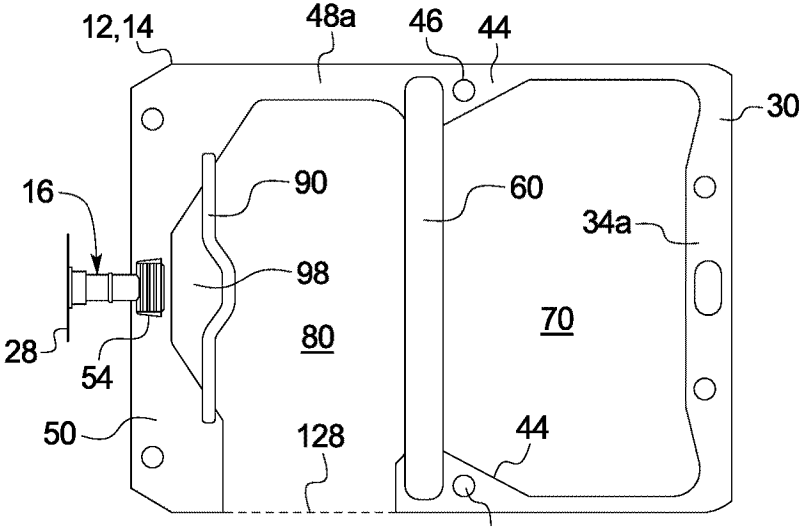
FIGS. 10A to 10D are front views illustrating different manufacturing stages of one embodiment for making a dual chamber container or bag of the present disclosure.
Figure 10D:
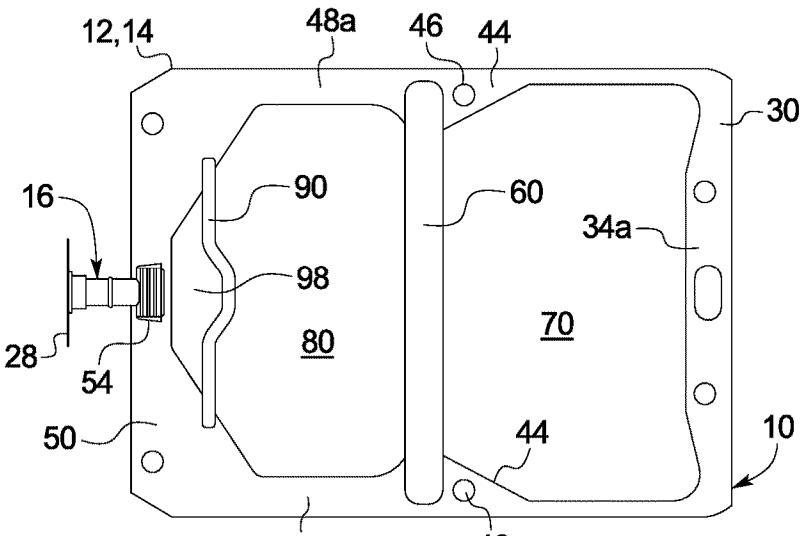
Figure 10A:
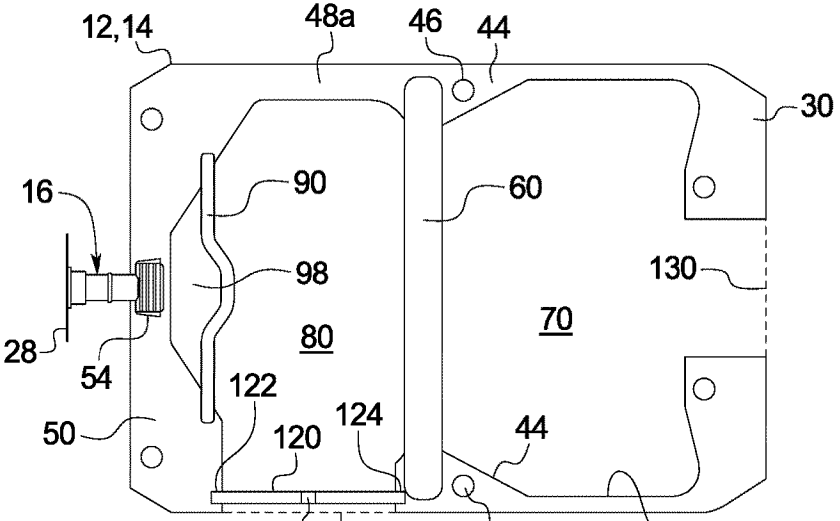
Figure 10B:
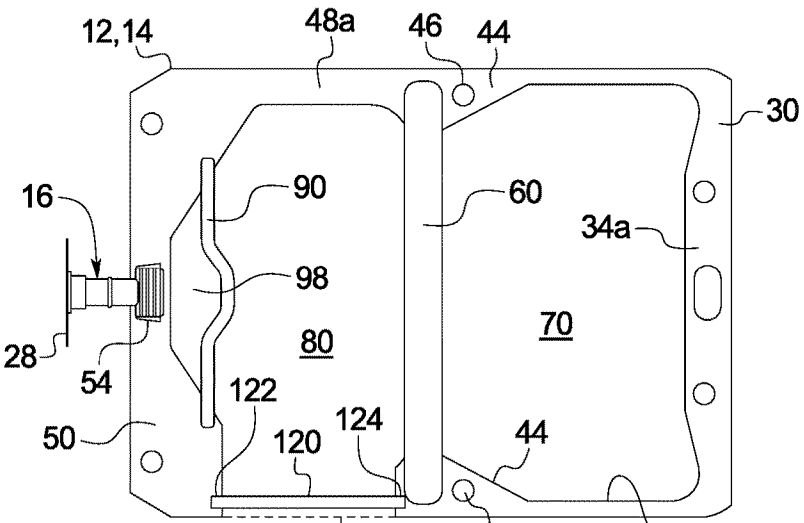

FIGS. 10A, 10B and 10C illustrate that in formative stages of dual chamber bag 10, there are portions of certain peripheral edges of the bag where sheets 12 and 14 are not sealed together to have a strong seal. Those edges are indicated in dashed line. In particular, FIGS. 10A, 10B and 10C illustrate via dashed line 128 that sheets 12 and 14 are unsealed at powdered drug strong seal portions 48*b*, which is illustrated as being sealed in FIG. 10D. Additionally, FIG. 10A illustrates via dashed line 130 that sheets 12 and 14 are unsealed at upper seam area 34*a*, which is illustrated as being sealed in FIGS. 10B to 10D.

FIGS. 10A and 10B also illustrate that during the formative stages of dual chamber bag 10, an additional lateral and temporary peel seal 120 is provided. Lateral peel seal 120 includes a first end 122 that extends to strong bottom seam 50 and a second end 124 that extends to side 40*b*. Temporary peel seal 120 has a length sufficient to provide a suitable opening to receive powdered drug 88 in a later manufacturing step. In a non-limiting example, lateral peel seal 120 may be about 2 mm to about 10 mm wide and about 50 mm to about 90 mm long and have the same seal strength (force required to open), greater seal strength or a lower seal strength than delivery peel seal 90. In an embodiment, lateral peel seal 120 may have a seal strength of approximately seal of 1 to 5 N/15 mm, and in one embodiment be 3 N/15 mm.

Lateral peel seal 120 in the illustrated embodiment is initially formed with a small opening or aperture 126, which is sized to accept a discharge tube or nozzle of an injection gas filling station (not illustrated). Opening or aperture 126 may, for example, be long enough to accept a 6 mm to 10 mm outer diameter inert gas filling tube or nozzle. The injection gas may be an inert gas such as nitrogen, argon, carbon dioxide or mixtures thereof. If it becomes imperative to remove as much oxygen as possible from drug chamber 80, an oxygen "getter" gas, such as hydrogen or silane may be used instead or in combination with any one or more of the inert gases mentioned above.

In the formative manufacturing stage of FIG. 10A, it should be appreciated that the majority of strong seals described above have been formed, mixing peel seal 60 and delivery peel seal 90 have been formed according to their specifications discussed above, administration port 16 has been fully formed including tear strip 28, and administration port 16 has been inserted into and sealed to center section 54 of bottom strong seal 50. Dual chamber bag 10 is open (not strong sealed) at the dashed line sections that eventually form powdered drug portion 48*b* of side seam 40*b* (lateral dashed line 128) and upper seam area 34*a* (upper dashed line 130). Lateral peel seal 120 is in tact and has been formed with opening or aperture 126.

The formative manufacturing stage of FIG. 10A may be said to be an initial filling stage in which diluent is introduced into diluent chamber 70 and an inert and/or getter gas is introduced into drug chamber 80. In particular, diluent, e.g., dextrose or saline, may be pumped or gravity fed (in either case metered precisely) at a desired volume into diluent chamber 70 through the opening between sheets 12 and 14 formed at dashed line 130. In one embodiment, immediately after the delivery of diluent into diluent chamber 70, the opening between sheets 12 and 14 formed at dashed line 130 is sealed with a strong seal via any of the sealing methods discussed herein, such that upper seam 30 is fully formed (i) with upper seam at area 34*a* having oval 34 and (ii) to have a desired strong sealing strength.

Any of the gases or blends discussed above may be injected, e.g., under a slight pressure so as not unduly stress dual chamber container 10, into drug chamber 80 at a desired volume through opening or aperture 126 formed in lateral peel seal 120. Opening or aperture 126 may be sized to be large enough to allow air to be flushed out of drug chamber 80 around the outside of the inert gas delivery nozzle or tube by the injection of inert (and/or getter) gas. Or, if opening or aperture 126 more or less seals to the gas delivery nozzle or tube, a second small opening (not illustrated) may be provided to vent air pushed out of drug chamber 80 by the injected gas.

In one embodiment, immediately after the injection of the inert (and/or getter) gas, opening or aperture 126 (and second opening if provided) is sealed via any of the sealing methods discussed herein, such that lateral peel seal 120 is fully formed to have a desired sealing strength. The injected gas is thereby trapped within drug chamber 80 and is provided in a quantity such that sheets 12 and 14, at least over a majority of drug chamber 80, are separated. The injected gas servers dual purposes, namely, to (i) remove oxygen to help sterility and (ii) maintain sheets 12 and 14 to form a spaced relationship between the sheets, which helps to prevent the sheets from sticking to each other and also aids in the eventual opening of lateral peel seal 120, as discussed in more detail below.

Each of the above-described steps performed in connection with FIG. 10A, and any steps leading up to FIG. 10A, may be performed in a non-aseptic environment. The steps in connection with FIG. 10B however are performed in a sterilizing, e.g., steam sterilizing, environment. As discussed above, opening or aperture 126 no longer exists in lateral peel seal 120 of FIG. 10B. Upper seam 30 having upper seam at area 34*a* is fully formed and trimmed from the width illustrated in FIG. 10A (or folded over for extra strength along upper seam) so as to have a desired width, and such that dashed line 130 forming the diluent filling opening no longer exists.

If steam sterilized, dual chamber container or bag 10 at FIG. 10B is placed in an autoclave (along with many other such bags or containers) and subjected to steam for a designated amount of time. As mentioned above, steam is able to penetrate tear strip 28 to reach all surfaces of within administration port 16 between tear strip 28 and septum or insert 24. It has also been found that while the remainder of the inside of administration port 16, the inside of delivery administration area 98, and the inside of drug chamber 80 are relatively dry, that steam sterilization nonetheless adequately sterilizes those inner volumes and the surfaces forming same. If needed, it is contemplated to increase the humidity of the inert and/or getter gas delivered to the diluent chamber 80 to, e.g., fifty to one-hundred percent humidity, to aid the steam sterilization of the drug chamber. Diluent chamber 70 having been filled with diluent is readily sterilized under steam sterilization. After steam sterilization, dual chamber bags 10 are allowed to dry, either in a stationary location and/or during transit.

After steam sterilization in FIG. 10B, container or bag 10 is dried and moved in an aseptic manner from the sterilizing station, e.g., steam sterilization autoclave, into a cleanroom which has a classification suitable for handling powdered drug 88. In FIG. 10C, once inside the cleanroom, lateral peel seal 120 is opened. Because drug chamber 80 contains injected gas, sheets 12 and 14 are separated from each other, thereby providing support for opposing suction cups (or other structure) to assist in forming a suction attachment with drug chamber 80 and to ensure that a resulting pulling force is applied only to the sheet 12 or 14 to which the cup is in contact.

In one embodiment, with the injected gas maintaining sheets 12 and 14 in an open condition throughout at least a portion of drug chamber 80, at least one suction cup (not illustrated) is suctioned to each of separated sheets 12 and 14. In an embodiment, the at least one suction cup for sheet 12 is located approximately midway between peel seals 60 and 90 but closer to lateral peel seal 120 than to powdered drug portion 48*a* of side seam 40*a*, e.g., one-third or one-quarter of the total width away from lateral peel seal 120 and two-thirds or three-quarters, respectively, of the total width away from powdered drug portion 48*a* of side seam 40*a*. The at least one suction cup for sheet 14 is likewise located approximately midway between peel seals 60 and 90 but closer to lateral peel seal 120 than to powdered drug portion 48*a* of side seam 40*a*, e.g., one-third or one-quarter of the total width away from lateral peel seal 120 and two-thirds or three-quarters, respectively, of the total width away from powdered drug portion 48*a* of side seam 40*a*.

Once suctioned to sheets 12 and 14, the suction cups are moved apart a specified distance to open lateral peel seal 120 a desired amount for powdered drug filling, and at a specified speed so as not to create undue force that may inadvertently open either one or both of peel seals 60 and 90. The suctioning, e.g., pneumatic, used to suction the cups to sheets 12 and 14 may be terminated to release sheets 12 and 14 before, during or after the delivery of powdered drug 80, as desired or needed. If before drug delivery, the insertion of a powdered drug insertion nozzle or tube (not illustrated) may be precise and forceful enough to fit through opened lateral peel seal 120 even if sheets 12 and 14 close together at dashed line 128 partially or fully. If during or after drug delivery, the insertion of a powdered drug nozzle or tube may rely on the suction cups to maintain lateral peel seal 120 in an open state so that the powdered drug nozzle or tube may readily enter drug chamber 80 to deliver the powdered drug.

Any of the powdered drugs listed herein may be injected and/or gravity fed in a metered and known quantity into drug chamber 80 after lateral peel seal 120 has been opened. As discussed earlier, such filling is performed in an aseptic, cleanroom environment.

In FIG. 10D, container or bag 10 filled will both diluent and powdered drug 88 is moved, for example, along a conveyor line within the cleanroom to a bag sealing mechanism that provides a final strong seal at powdered drug portion 48*b* of side seam 40*b*, where lateral peel seal 120 resided previously. Dual chamber container or bag 10 is fully formed in FIG. 10D except for two final steps, namely, (i) the peel seal application of removable cover or foil layers 100, one layer 100 each to either side of drug chamber 80 and (ii) the overpouching of dual chamber container or bag 10 having the applied removable cover or foil layers 100.

Figure 11:
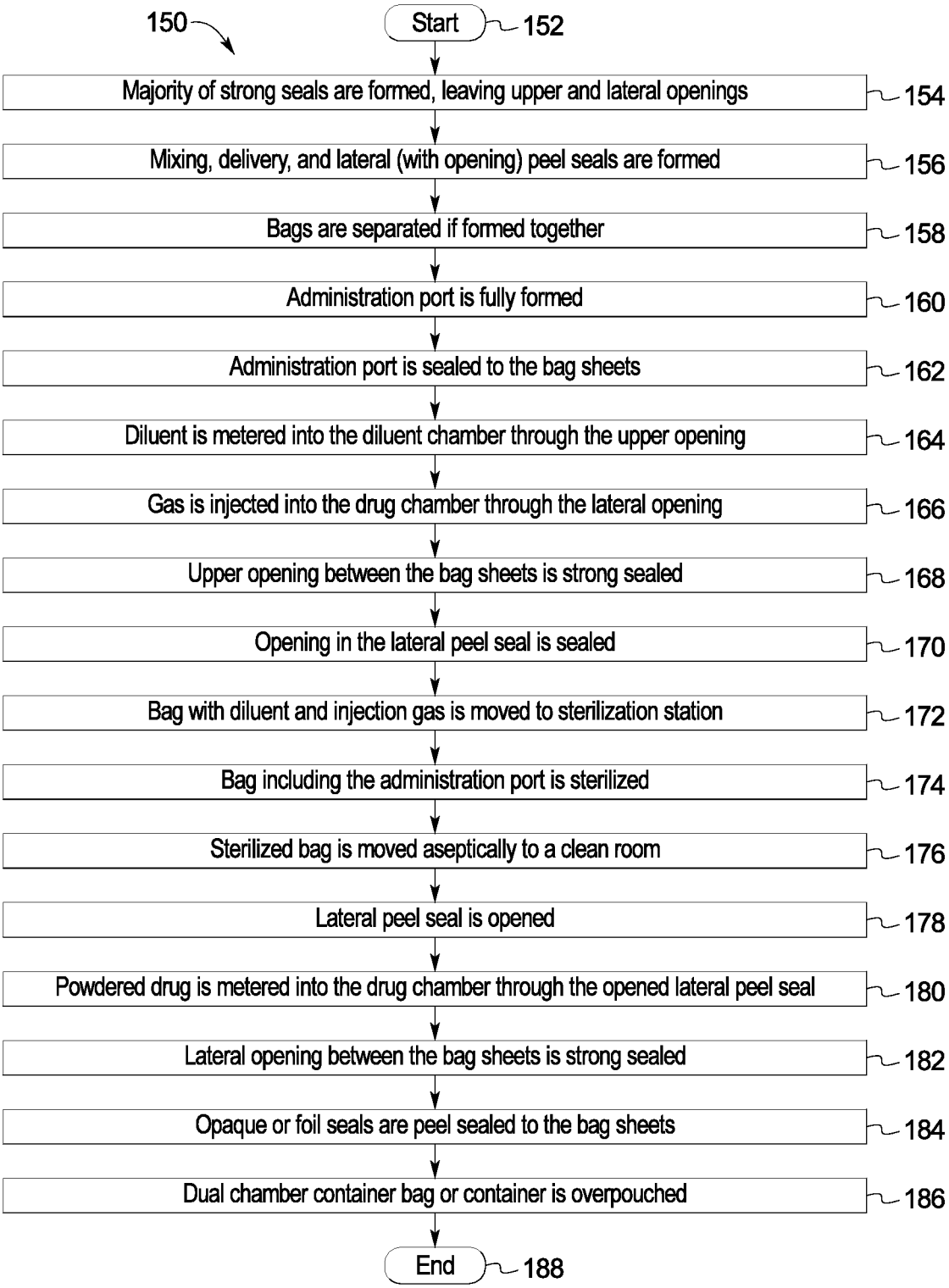
FIG. 11 is a schematic diagram further illustrating the method of FIGS. 10A to 10D for making the dual chamber container or bag of the present disclosure.

The formation of dual chamber container or bag 10 has been described in detail in connection with FIGS. 10A to 10D. FIG. 11 illustrates one method 150 listing the steps discussed above without the detail just provided, but wherein such detail is expressly incorporated. The order of the steps in FIG. 11 may be changed as needed or desired (for example, blocks 154, 156 and 160 could be in a different order, while blocks 168 and 170 could be in a different order).

At oval 152, method 150 begins.

At block 154, the majority of strong seals are formed, leaving upper and lateral openings.

At block 156, the mixing, delivery and lateral (with opening) peel seals are formed.

At block 158, the bags are separated if formed together.

At block 160, the administration port is fully formed.

At block 162, the administration port is sealed to the bag sheets.

At block 164, diluent is metered into the diluent chamber through the upper opening.

At block 166, gas is injected into the drug chamber through the lateral opening.

At block 168, the upper opening between the bag sheets is strong sealed closed.

At block 170, the opening in the lateral peel seal is weak peel sealed closed.

At block 172, the bag with diluent and injection gas is moved to sterilization station.

At block 174, the bag including the administration port is sterilized and dried.

At block 176, the sterilized bag is moved aseptically to a cleanroom.

At block 178, the lateral peel seal is opened inside the cleanroom.

At block 180, powdered drug is metered into the drug chamber through the opened lateral peel seal.

At block 182, the lateral opening between the bag sheets is strong sealed.

At block 184, opaque or foil seals are weak sealed to the bag sheets.

At block 186, the dual chamber container or bag is overpouched.

At oval 188, method 150 ends.

Alternative Method of Making

Referring now to FIGS. 12A to 12E, dual chamber bag 10 is illustrated in various intermediate stages of manufacture using an alternative method than method 150. Again, for purposes of illustration, opaque layers 100 are not shown. Also, only the element numbers relevant for FIGS. 12A to 12E are provided; however, each of the structure, functionality and alternatives discussed for any of the element numbers found in FIGS. 1A to 9 is applicable to dual chamber bag 10 prepared via the intermediate steps of FIGS. 12A to 12E. FIGS. 12A to 12E are similar to FIGS. 10A to 10D in that corners 44 in FIGS. 12A to 12E are angled instead of curved. Another similarity is that an extra aperture 46 is formed in FIGS. 10A to 10D and 12A to 12E.

Figure 12A:
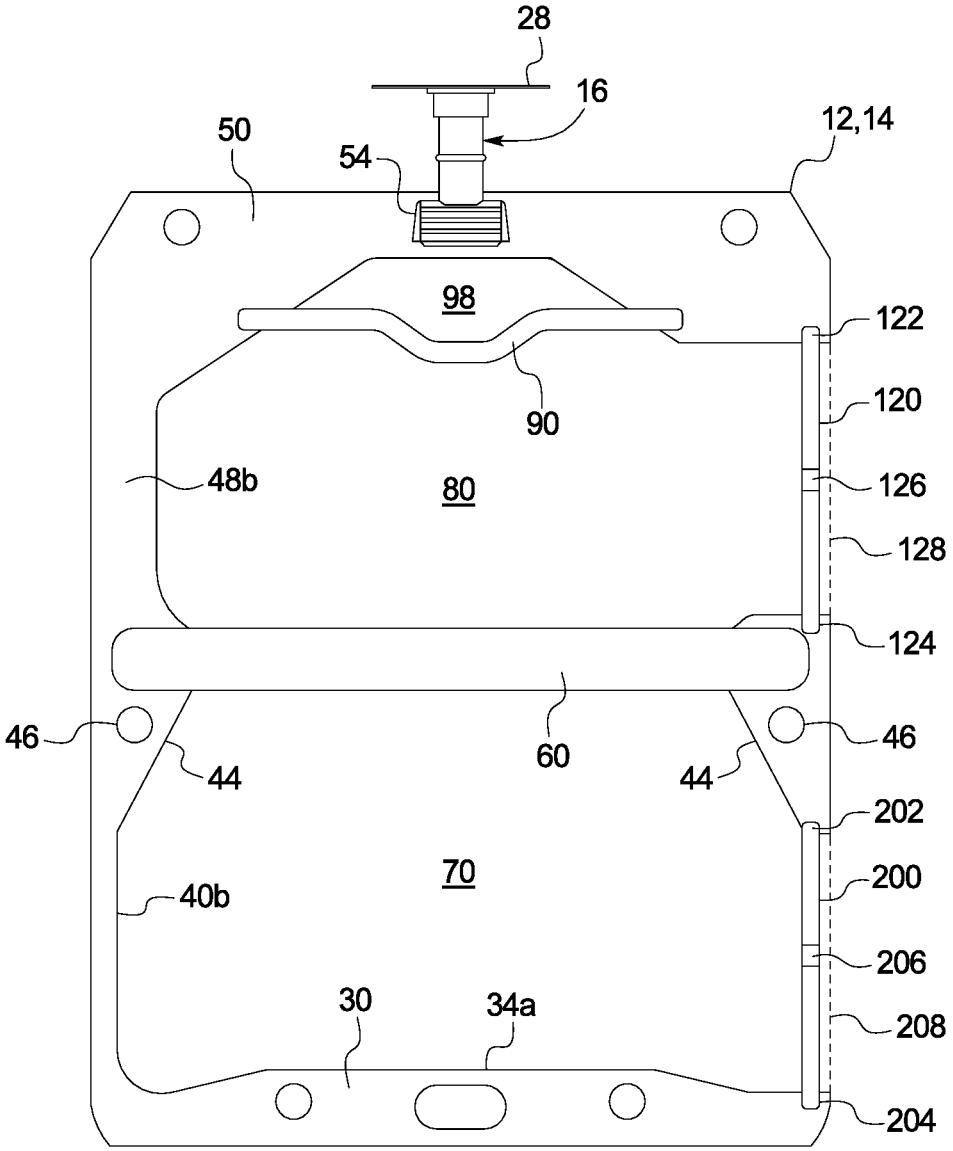
FIGS. 12A to 12E are front views illustrating different manufacturing stages of an alternative embodiment for making a dual chamber container or bag of the present disclosure.

FIG. 12A illustrates that in formative stages of dual chamber bag 10, there are portions of certain peripheral edges of the bag where sheets 12 and 14 are not sealed together to have a strong seal. Those edges are indicated in dashed line. In particular, FIG. 12A illustrates via dashed line 128 that sheets 12 and 14 are unsealed at powdered drug strong seal portion 48*a*, which is illustrated as being sealed in FIGS. 1A to 3, for example. Additionally, FIG. 12A illustrates via dashed line 208 that sheets 12 and 14 are unsealed at the diluent portion of side seam 40*a*, which is likewise illustrated as being sealed in FIGS. 1A to 3, for example. Notably, dashed line 130 in FIG. 10A is not provided in FIG. 12A and is not needed to fill diluent chamber 70 with diluent in the method of making associated with FIGS. 12A to 12E. Upper seam area 34*a* of upper seam 30 may be formed with the other strong seals of container or bag 10 as illustrated in FIG. 12A.

As with FIGS. 10A and 10B, FIG. 12A illustrates that during the formative stages of dual chamber bag 10, additional lateral peel seal 120 is provided. As before, lateral peel seal 120 includes a first end 122, second end 124 and small opening or aperture 126, which is sized to accept a discharge tube or nozzle of an injection gas filling station (not illustrated). Peel seal 120 again has a length sufficient to provide a suitable opening to receive powdered drug 88. Lateral peel seal 120 may again be about 2 mm to about 10 mm wide and about 50 mm to about 90 mm long and have the same seal strength (force required to open), greater seal strength or a lower seal strength than delivery peel seal 90. Lateral peel seal 120 may again have a seal strength of approximately seal of 1 to 5 N/15 mm, and in one embodiment be 3 N/15 mm.

The primary difference between the formative stage of container or bag in FIGS. 12A to 12E and that of FIGS. 10A to 10C is that in FIG. 12A a second lateral and temporary peel seal 200 is provided to aseptically fill diluent chamber 70. Lateral peel seal 200 is provided in place of the upper portion of strong side seal 40*a*. It should be appreciated in viewing FIGS. 10A to 10C and 12A that lateral and temporary peel seals 120 and 200 may be placed on either side 40*a* or 40*b* of the bag. Moreover, in FIG. 12A, lateral peel seals 120 and 200 may be placed on the same or opposing sides of the bag.

Diluent peel seal 200 may be formed to be the same as or slightly different than powdered drug peel seal 120. Diluent peel seal 200 includes a first end 202 that extends to curved or angled corner 44 and a second end 204 that extends to upper seam 30. Diluent peel seal 200 has a length sufficient to provide a suitable opening to receive diluent in a later manufacturing step. In a non-limiting example, diluent peel seal 200 may be about 2 mm to about 10 mm wide and about 50 mm to about 90 mm long and have the same seal strength (force required to open), greater seal strength or a lower seal strength than delivery peel seal 90. In an embodiment, diluent peel seal 200 may have a seal strength of approximately seal of 1 to 5 N/15 mm, and in one embodiment be 3 N/15 mm.

Diluent peel seal 200 in the illustrated embodiment is initially formed with a small opening or aperture 206, which is sized to accept a discharge tube or nozzle of an injection gas filling station (not illustrated). Opening or aperture 206 may for example be long enough to accept a 6 mm to 10 mm outer diameter injection gas filling tube or nozzle. The injection gas may again be inert, such as nitrogen, argon, carbon dioxide or mixtures thereof and/or include an oxygen "getter" gas, such as hydrogen or silane.

Primary differences between the method of making in FIGS. 10A to 10D and that of FIGS. 12A to 12E is that in FIGS. 12A to 12E, (i) filling of both drug 88 and diluent is done aseptically in a cleanroom and (ii) two lateral and temporary peel seals 120 and 200 are employed. FIG. 12A is formed in a non-ascetic environment. In the non-ascetic environment, the majority of strong seals (except at dashed lines 128 and 208) are formed, mixing peel seal 60 and delivery peel seal 90 are formed according to their specifications discussed above, administration port 16 is fully formed including tear strip 28, and administration port 16 is inserted into and sealed to center section 54 of bottom strong seal 50. Lateral drug peel seal 120 (with opening 126) and lateral diluent peel seal 200 (with opening 206) are also formed according to their specifications discussed above.

Next, injection gas is introduced into powdered drug chamber 80 and diluent chamber 70 via openings 126 and 206, respectively. Openings 126 and 206 are then immediately closed to trap injection the gas within chambers 70 and 80.

Next, each empty (except for injection gas) container or bag of FIG. 12A is sterilized. Because the bag of FIG. 12A is empty, steam sterilization is not optimal. Nevertheless, steam sterilization could be employed. Sterilization via ethylene oxide is also an option. More likely, however, the containers or bags of FIG. 12A are irradiated, e.g., gamma or electron beam (Ebeam) radiation, sterilized. Once sterilized, the bags of FIG. 12A are delivered in an aseptic manner to a cleanroom. In an embodiment, if multiple containers are formed together, they are separated at some point prior to entering the cleanroom.

Figure 12B:
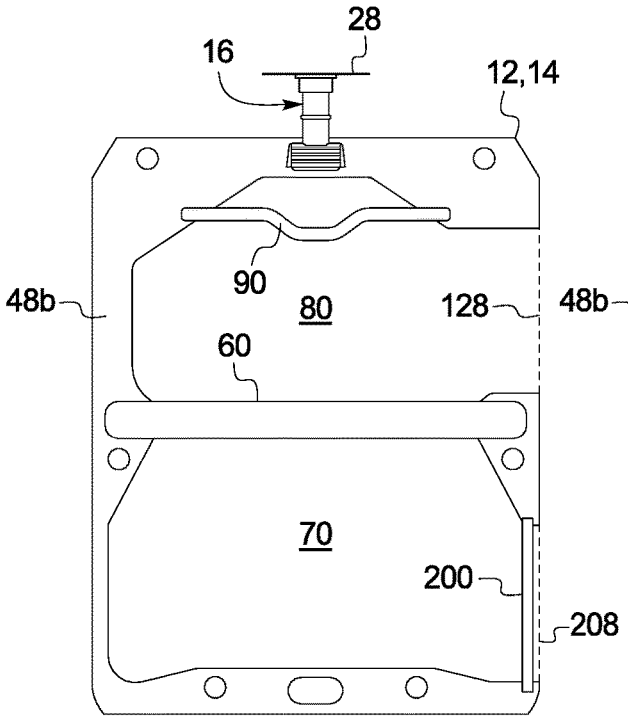

FIGS. 12B to 12E illustrate what happens to the container or bag of FIG. 12A once inside the cleanroom. In FIG. 12B, once inside the cleanroom, lateral drug peel seal 120 is opened. Because drug chamber 80 contains injected gas, sheets 12 and 14 are separated from each other, thereby providing support for opposing suction cups (or other structure) to assist in forming a suction attachment with drug chamber 80 and to ensure that a resulting pulling force is applied only to the sheet 12 or 14 to which the cup is in contact. The use of suction cups or any other device for providing a pulling force, and all structure, functionality and alternatives for same discussed above in connection with FIG. 10C, is equally applicable to the opening of lateral drug peel seal 120 of FIG. 12B.

With peel seal 120 of FIG. 12B opened, leaving the opening illustrated by dashed line 128, any of the powdered drugs listed herein may be injected and/or gravity fed in a metered and known quantity into drug chamber 80. Such filling is performed in the aseptic, cleanroom environment. Notably, in FIG. 12B, lateral diluent peel seal 200 for diluent chamber 70 remains in tact.

Figure 12C:
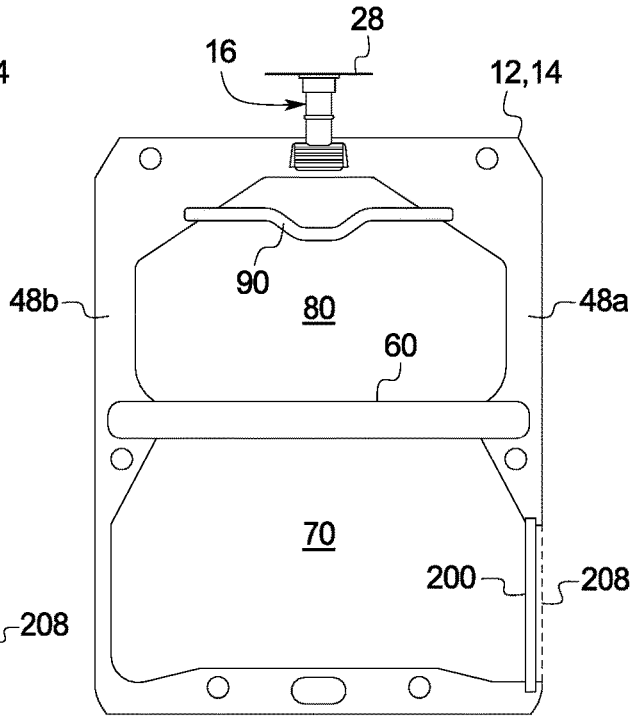

In FIG. 12C, with powdered drug 88 injected into powdered drug chamber 80, powdered drug portion 48*a* of strong side seam 40*a* is formed aseptically, completing powdered drug chamber 80 and trapping powdered drug 88 within same. Notably, in FIG. 12C, lateral diluent peel seal 200 for diluent chamber 70 remains in tact.

Figure 12D:
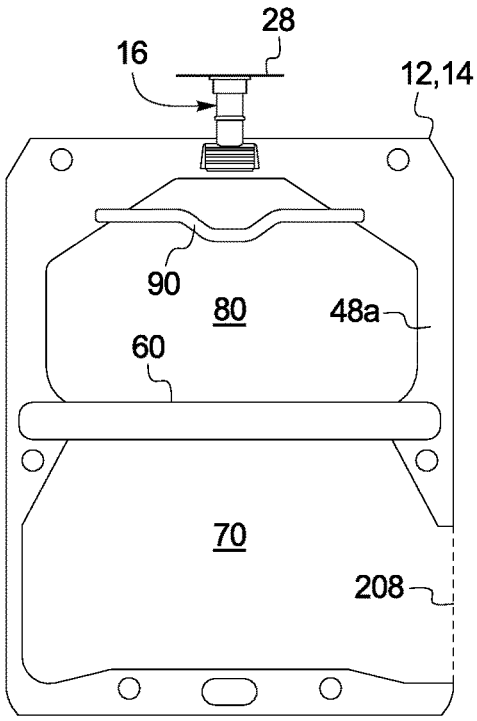

In FIG. 12D, lateral diluent peel seal 200 is opened. Because diluent chamber 70 contains injected gas, sheets 12 and 14 are separated from each other, thereby providing support for opposing suction cups (or other structure) to assist in forming a suction attachment with diluent chamber 70 and to ensure that a resulting pulling force is applied only to the sheet 12 or 14 to which the cup is in contact. The use of suction cups or any other device for providing a pulling force, and all structure, functionality and alternatives for same discussed above in connection with FIG. 10C, is equally applicable to the opening of lateral diluent peel seal 200 of FIG. 12D.

With temporary peel seal 200 of FIG. 12D opened, leaving the opening illustrated by dashed line 208, any of the diluents listed herein may be injected and/or gravity fed in a metered and known quantity into diluent chamber 70. Such filling is likewise performed in the aseptic, cleanroom environment.

Figure 12E:
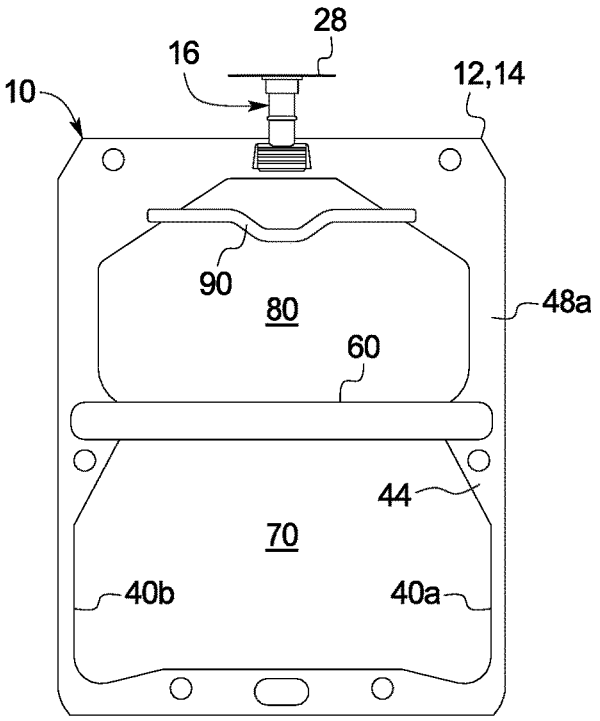

In FIG. 12E, with diluent injected into diluent chamber 70, diluent portion of strong side seam 40*a* between curved or angled corner 44 and upper seam 30 is formed aseptically, completing diluent chamber 70 and trapping the diluent within same. In FIG. 12E, dual chamber container or bag 10 is substantially formed except for the opaque layers 100 and the overpouch.

It should be appreciated that for both the methods of FIGS. 10A to 10D and 12A to 12E, an in-process control step in which the desired quantity of powdered drug 88 is verified to have been metered to powdered drug chamber 80. Such check may be made via one or both of a load cell sensor and/or a vision check. With the load cell, one or both of a weight of drug 88 added to container or bag 10 and/or a weight of drug 88 removed from a supply may be analyzed. Also, containers or bags 10 at FIGS. 10D and 12E may be washed and dried prior to the addition of opaque layers 100, all of which may be performed non-aseptically along with the addition of the overpouch. Further, for both the methods of FIGS. 10A to 10D and 12A to 12E, container or bag 10 may be leak checked prior to overpouching.

Figure 13:
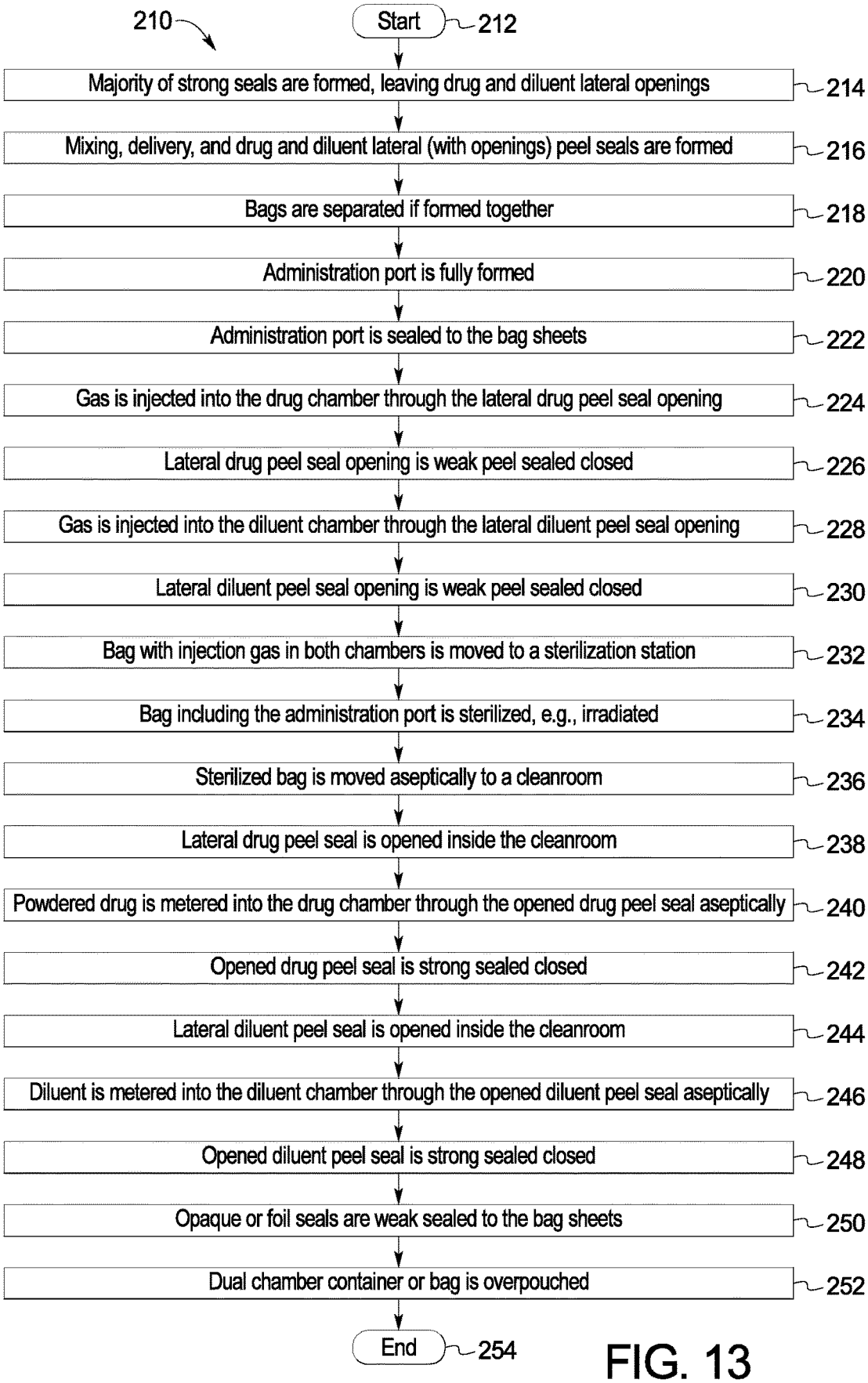
FIG. 13 is a schematic diagram illustrating in cooperation with FIGS. 12A to 12E an alternative embodiment for making the dual chamber container or bag of the present disclosure.

An alternative formation of dual chamber container or bag 10 has been described in detail in connection with FIGS. 12A to 12E. FIG. 13 illustrates one method 210 listing the steps discussed above without the detail just provided, but wherein such detail is expressly incorporated. The order of the steps in FIG. 13 may be changed as needed or desired (for example, aseptic filling of diluent may occur before aseptic filling of powdered drug 80, formation of seals may be switched, and administration port 16 may be formed at any time prior to its sealing).

At oval 212, method 210 begins.

At block 214, the majority of strong seals are formed, leaving drug and diluent lateral openings.

At block 216, the mixing, delivery, and drug and diluent lateral (with openings) peel seals are formed.

At block 218, the bags are separated if formed together.

At block 220, the administration port is fully formed.

At block 222, the administration port is sealed to the bag sheets.

At block 224, gas is injected into the drug chamber through the lateral drug peel seal opening.

At block 226, the lateral drug peel seal opening is weak peel sealed closed.

At block 228, gas is injected into the diluent chamber through the lateral diluent peel seal opening.

At block 230, the lateral diluent peel seal opening is weak peel sealed closed.

At block 232, the bag with injection gas in both chambers is moved to a sterilization station.

At block 234, the bag including the administration port is sterilized, e.g., gamma radiation sterilized.

At block 236, the sterilized bag is moved aseptically to a cleanroom.

At block 238, the lateral drug peel seal is opened inside the cleanroom.

At block 240, powdered drug is metered into the drug chamber through the opened drug peel seal aseptically.

At block 242, the opened drug peel seal is strong sealed closed.

At block 244, the lateral diluent peel seal is opened inside the cleanroom.

At block 246, diluent is metered into the diluent chamber through the opened diluent peel seal aseptically.

At block 248, the opened diluent peel seal is strong sealed closed.

At block 250, opaque or foil seals are weak sealed to the bag sheets.

At block 252, the dual chamber container or bag is overpouched.

At oval 254, method 210 ends.

Product Using Dual Chamber Bag

To reduce the volume and weight of powdered drug 88 needed, and to reduce the amount of aseptic filling that needs to be performed, it is contemplated to remove one or more component of dry drug powder 88 and to provide it instead with the liquid diluent. Components suitable for removal from the drug powder include buffers, tonicity adjusters or other soluble components normally provided with the powder. The removed component is provided instead in the liquid diluent, which may be particularly beneficial if there is a risk of interaction between the powdered components.

Similarly, it is possible that in the event that a very small volume of drug powder 88 is required, some fraction of the dextrose or sodium chloride ordinarily dissolved in the diluent might instead be provided in powder 88 to increase its volume for greater ease of handling.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims. For example, while the structure and functionality have been described in connection with a flexible bag, certain structure and functionality described herein are applicable to other types of fluid containers, such as other medical fluid containers. Also, while the structure and functionality have been described in connection with a dual chamber container, much of the structure and functionality described herein are applicable to containers having a single chamber or three or more chambers. Moreover, in an alternative embodiment, the gas insertion into the powdered drug chamber may be performed in the cleanroom after sterilization. In a further alternative embodiment, the powdered drug may be filled through the administration port instead of through the lateral peel seal, wherein the administration port is thereafter fitted with or formed to have septum or insert 24.

The invention is claimed as follows:

1. A multiple chamber container forming and filling method comprising:

forming at least one strong seal around a periphery of first and second sheets so as to leave an opening between the first and second sheets;

forming a temporary peel seal across the opening, wherein forming the temporary peel seal across the opening includes leaving a smaller opening than the opening between the first and second sheets in the temporary peel seal to accept a gas injecting structure;

forming a mixing peel seal between the first and second sheets so as to separate a diluent chamber from a powdered drug chamber;

adding diluent to the diluent chamber;

sterilizing the multiple chamber container including the diluent;

opening the temporary peel seal in an aseptic environment;

adding powdered drug to the powdered drug chamber through the opening;

strong sealing the opening so as to be closed; and forming a delivery peel seal between the powdered drug chamber and an outlet of the multiple chamber container.

2. The multiple chamber container forming and filling method of claim 1, wherein the opening is a first opening, and wherein forming the at least one strong seal around the periphery of the first and second sheets includes leaving a second opening between the first and second sheets for adding the diluent.

3. The multiple chamber container forming and filling method of claim 2, which includes strong sealing the second opening so as to be closed prior to sterilizing the multiple chamber container.

4. The multiple chamber container forming and filling method of claim 1, wherein the delivery peel seal between the powdered drug chamber and the outlet of the multiple chamber container has a seal strength the same or lower than that of the mixing peel seal.

5. The multiple chamber container forming and filling method of claim 1, which includes inserting a gas into the powdered drug chamber through the smaller opening and closing the smaller opening after inserting the gas through the smaller opening.

6. The multiple chamber container forming and filling method of claim 1, which includes inserting gas into the powdered drug chamber prior to opening the temporary peel seal.

7. The multiple chamber container forming and filling method of claim 6, wherein the gas is at least one of an inerting gas or an oxygen getting gas.

8. The multiple chamber container forming and filling method of claim 6, wherein the gas separates the first and second sheets, and wherein opening the temporary peel seal includes suctioning the separated first and second sheets and pulling on the temporary peel seal.

9. The multiple chamber container forming and filling method of claim 1, wherein the opening and the temporary peel seal border the powdered drug chamber.

10. The multiple chamber container forming and filling method of claim 1, which includes sterilizing the powdered drug prior to adding the powdered drug to the powdered drug chamber through the opening.

11. A multiple chamber container forming and filling method comprising:

forming at least one strong seal around a periphery of first and second sheets so as to leave an opening between the first and second sheets;

forming a temporary peel seal across the opening, wherein forming the temporary peel seal across the opening includes leaving a smaller opening than the opening between the first and second sheets in the temporary peel seal to accept a gas injecting structure;

forming a mixing peel seal between the first and second sheets so as to separate a diluent chamber from a powdered drug chamber;

adding diluent to the diluent chamber;

sterilizing the multiple chamber container including the diluent;

drying the multiple chamber container and moving the multiple chamber container into a clean room forming an aseptic environment;

opening the temporary peel seal in the clean room;

adding powdered drug to the powdered drug chamber through the opening in the clean room;

strong sealing the opening in the clean room so as to be closed; and forming a delivery peel seal in the clean room between the powdered drug chamber and an outlet of the multiple chamber container.

* * * * *